US011092071B1

(12) United States Patent
Warren

(10) Patent No.: US 11,092,071 B1
(45) Date of Patent: Aug. 17, 2021

(54) OPPOSED PISTON ENGINE AND ELEMENTS THEREOF

(71) Applicant: Warren Engine Company, Inc., Bluemont, VA (US)

(72) Inventor: James C. Warren, Alexandria, VA (US)

(73) Assignee: Enginuity Power Systems, Inc., Alexandria, VA (US)

( * ) Notice: Subject to any disclaimer, the term of this patent is extended or adjusted under 35 U.S.C. 154(b) by 174 days.

(21) Appl. No.: 14/531,921

(22) Filed: Nov. 3, 2014

Related U.S. Application Data

(60) Provisional application No. 61/899,114, filed on Nov. 1, 2013.

(51) Int. Cl.
*F02B 75/28* (2006.01)
*F02F 7/00* (2006.01)

(52) U.S. Cl.
CPC ..... *F02B 75/282* (2013.01); *F02F 7/0009* (2013.01)

(58) Field of Classification Search
CPC ..... F02B 75/282; F02F 7/0009
USPC ..... 123/51 R
See application file for complete search history.

(56) References Cited

U.S. PATENT DOCUMENTS 2,419,531 A * 4/1947 Bronander ..... F01B 7/14 123/51 BB
3,550,568 A * 12/1970 Peterson ..... F02B 75/224 123/51 BD
8,474,435 B2 * 7/2013 Lemke ..... F01B 7/14 123/197.4
2010/0212638 A1 * 8/2010 Rado ..... F01B 7/14 123/51 R

* cited by examiner

*Primary Examiner* — Kevin A Lathers
(74) *Attorney, Agent, or Firm* — Capitol Patent & Trademark Law Firm, PLLC

(57) ABSTRACT

An opposed piston engine includes an engine housing (20), at least one cylinder housing (300) coupled to the engine housing, and a cylinder (210) supported by the at least one cylinder housing (300). The cylinder has a first end and a second end opposite the first end. Each of the first and second cylinder ends is directly supported by the engine housing (20).

10 Claims, 24 Drawing Sheets

OPPOSED PISTON ENGINE AND ELEMENTS THEREOF

CROSS-REFERENCE TO RELATED APPLICATIONS

This application is a continuation-in-part of, and claims the benefit of, U.S. application Ser. No. 13/633,097, filed on Oct. 1, 2012, which claims the benefit of provisional application Ser. Nos. 61/542,069, filed on Sep. 30, 2011, and 61/580,606, filed on Dec. 27, 2011, all of which are incorporated herein by reference in their entireties. This application also claims the benefit of U.S. Provisional Application Ser. No. 61/899,114, filed on Nov. 1, 2013, the disclosure of which is incorporated herein by reference in its entirety.

FIELD OF THE INVENTION

The present invention generally relates to engines and, more particularly, to an opposed piston engine.

SUMMARY OF THE INVENTION

In one aspect of the embodiments described herein, an opposed piston engine is provided. The engine includes an engine housing (20), at least one cylinder housing (300) coupled to the engine housing, and a cylinder (210) supported by the at least one cylinder housing (300). The cylinder has a first end and a second end opposite the first end. Each of the first and second cylinder ends is directly supported by the engine housing (20).

In another aspect of the embodiments of the described herein, a cylinder structure for an opposed piston engine is provided. The cylinder structure includes an inner cylinder portion (210'-1) having a longitudinal central axis (Z') and a series of grooves (215) formed along an exterior surface thereof, and an outer cylinder portion (210'-2) structured to receive the inner cylinder portion therein and to abut the exterior surface of the inner cylinder portion (210'-1) so as to form an associated plurality of coolant passages along the grooves (215).

In another aspect of the embodiments of the described herein a cylinder housing for an opposed piston engine is provided. The cylinder housing includes a wall defining a central cavity, a first opening formed in the wall, and a second opening formed in the wall. A central axis of the first opening is coplanar with a central axis of the second opening along a plane substantially perpendicular to a longitudinal central axis of the central cavity.

DETAILED DESCRIPTION

Figure 1:
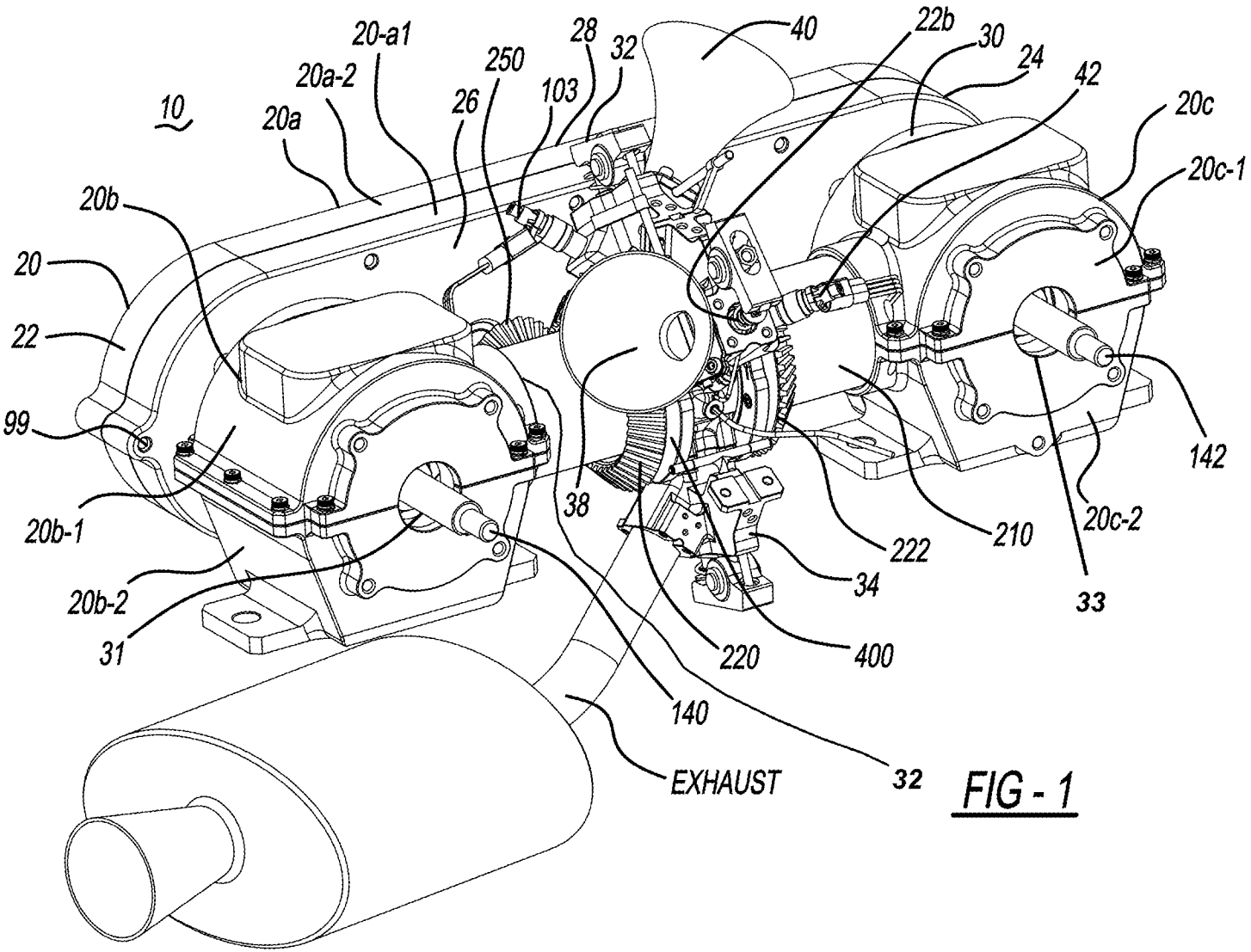
FIG. 1 is a perspective view of an opposed piston engine according to one embodiment of the present invention.

Like reference numerals refer to like parts throughout the description of several views of the drawings. In addition, while target values are recited for the dimensions of the various features described herein, it is understood that these values may vary slightly due to such factors as manufacturing tolerances, and also that such variations are within the contemplated scope of the embodiments described herein.

The exemplary embodiments described herein provide detail for illustrative purposes and are subject to many variations in structure and design. It is to be understood that the phraseology and terminology used herein are for the purpose of description and should not be regarded as limiting.

The terms "a" and "an" herein do not denote a limitation as to quantity, but rather denote the presence of at least one of the referenced items. Also, use herein of the terms "including," "comprising," "having" and variations thereof is meant to encompass the items listed thereafter and equivalents thereof as well as allowing for the presence of additional items. Further, the use of terms "first", "second", and "third", and the like herein do not denote any order, quantity, or relative importance of the items to which they refer, but rather are used to distinguish one element from another.

Unless limited otherwise, terms such as "configured," "disposed," "placed", "coupled to" and variations thereof herein are used broadly and encompass direct and indirect attachments, couplings, and engagements. In addition, the terms "attached" and "coupled" and variations thereof are not restricted to physical or mechanical attachments or couplings.

Similar reference characters denote similar features consistently throughout the attached drawings. Referring to the drawings, an opposed piston engine 10 according to one embodiment of the present invention is shown in FIGS. 1-6. The arrangement shown has aspects similar to embodiments and features of an opposed piston internal combustion engine described in U.S. Pat. No. 7,004,120, incorporated herein by reference in its entirety. The embodiment 10 of the opposed piston engine shown in FIGS. 1-6 is a four-cycle or four-stroke engine and while the figures show only one cylinder 210 of the engine for clarity, any number of cylinders may be utilized depending on the amount of power desired to be produced by the engine 10. In addition, the structural arrangements and operating principles described herein may alternatively be applied to a two-stroke engine.

In addition, elements of the engine (for example, any of the fuel injectors, throttle valves, and other engine components and/or sub-systems) may be operatively coupled to an engine control unit (ECU) (not shown) configured for regulating and optimizing various engine component and control functions, in a manner known in the art.

An engine housing 20 encloses the engine pistons, crankshafts, connecting rods, gear trains, and portions of the output shafts and other engine components which are operatively coupled to the pistons as described herein. The engine housing 20 may also serve as a base onto which other portions of the engine may be mounted or secured. The housing configuration shown in FIG. 1 accommodates a single pair of opposed pistons and associated engine components which are operatively coupled to the pistons. However, the engine housing may be configured to accommodate more than one pair of opposed pistons according to the requirements of a particular application.

In the embodiment shown in FIGS. 1-6, engine housing 20 has a hollow first portion 20*a* with a first end 22, a second end 24 opposite the first end, a first side 26, and a second side 28 opposite first side 26.

In the embodiment shown in FIGS. 1-6, first portion 20*a* is formed by two mating sections 20*a*-1 and 20*a*-2 which may be secured to each other using bolts 99 or any other suitable securement mechanism. Housing first portion 20*a* encloses and provides a mounting structure for a gear train, generally designated 112 (described in greater detail below), which is powered by operation of the engine. To this end, one or both of sections 20*a*-1 and 20*a*-2 may have bosses 100 (see FIG. 2A) or other features (not shown) formed thereon to facilitate rotatable mounting of gears and/or bearings thereon. Housing section 20*a*-1 may have openings 25 formed therein to enable coupling a shaft (for example, shaft 199 in FIG. 2A) to a gear of gear train 112, to provide rotation of the shaft in conjunction with the gear along first side 26 of housing first portion 20*a*. Similarly, housing section 20*a*-2 may have openings 30 formed therein to enable coupling a shaft to an associated gear of gear train 112, to provide rotation of the shaft in conjunction with the gear along second side 28 of housing first portion 20*a*.

A housing second portion 20*b* extends from first portion first side 26 at first portion first end 22, and a housing third portion 20*c* extends from first portion first side 26 at first portion second end 24. Housing second portion 20*b* encloses and/or provides a mounting structure for a portion of crankshaft 140 and an associated connecting rod 122. In the embodiment shown in FIGS. 1-6, housing second portion 20*b* is formed by an upper section 20*b*-1 and a lower section 20*b*-2 which may be secured to each other using bolts 98 or any other suitable securement mechanism. Lower section 20*b*-2 may be structured to provide a well or reservoir for oil suitable for lubricating the interfaces between the associated crankshaft and connecting rods, in a manner known in the art.

In addition, an opening 31 is formed at each end of housing second portion 20*b* to enable a portion of an associated crankshaft 140 to extend therethrough, so that the crankshaft may be coupled to an associated load. The housing second portion 20*b* may be structured to facilitate the mounting of bearings (not shown) thereon for supporting the portions of the crankshaft extending through the openings. Housing second portion 20*b* also has another opening 32 configured for receiving therein an end portion of an associated cylinder 210, to secure the end of the cylinder in place with respect to the engine housing. Suitable gaskets (not shown) may be provided for sealing a junction between housing second portion 20*b* and the cylinder to prevent escape of oil or gases from the engine housing interior.

Housing third portion 20*c* encloses and/or provides a mounting structure for a portion of crankshaft 142 and an associated connecting rod 132. In the embodiment shown, housing third portion 20*c* is formed by an upper section 20*c*-1 and a lower section 20*c*-2 which may be secured to each other using bolts 97 or any other suitable securement mechanism. Lower section 20*c*-2 may be structured to provide a well or reservoir for oil suitable for lubricating the interfaces between the associated crankshaft and connecting rods, in a manner known in the art.

In addition, an opening 33 is formed at each end of housing third portion 20*c* to enable a portion of an associated crankshaft 142 to extend therethrough, so that the crankshaft may be coupled to an associated load. The housing third portion 20*c* may be structured to facilitate the mounting of bearings (not shown) thereon for supporting the portions of the crankshaft extending through the openings. Housing third portion 20*c* also has another opening 34 configured for receiving therein an end portion of an associated cylinder 210, to secure the end of the cylinder in place with respect to the engine housing. Suitable gaskets (not shown) may be provided for sealing a junction between housing third portion 20*c* and the cylinder end to prevent escape of oil or gases from the engine housing interior.

Elements of housing 20 may be formed using any suitable process, such as casting, machining, and other processes, for example. Elements of the housing may be formed from steel, aluminum, or any other suitable material or materials. Housing second and third portions 20*b* and 20*c* may be formed as a single piece with housing portion 20*a*. Alternatively, as shown in FIGS. 1-6, housing second and third portions 20*b* and 20*c* may be formed separately from housing first portion 20*a* and then attached to the housing first portion using any suitable method. In one particular embodiment, second and third portions 20*b* and 20*c* are welded to respective ends of the housing first portion.

In another particular embodiment, bolts or other removable fasteners may be issued to attach the second and third housing portions 20*b* and 20*c* to first housing portion 20*a*. These attachment methods enable second and third housing portions 20*b* and 20*c* of various sizes to be attached to the housing first portion 20*a* containing the gear box 112, according the requirements of a desired engine configuration. Other attachment methods may also be used. If desired, suitable gaskets or seals may (not shown) be positioned along any seams between joined portions of the engine housing 20 to prevent the escape of lubricating oil and gases from the housing interior.

FIGS. 1-6 show an embodiment of the engine housing configured for receiving therein and/or supporting a single pair of opposed pistons, the cylinder in which these pistons reciprocate, and the various known associated elements (such as piston rods, bearings, crankshafts, etc.) directed to transferring energy generated by combustion of fuel to a load (or loads) operatively coupled to the crankshafts. This embodiment of the housing also houses a single gear train 112 powered by operation of the engine.

Figure 7:
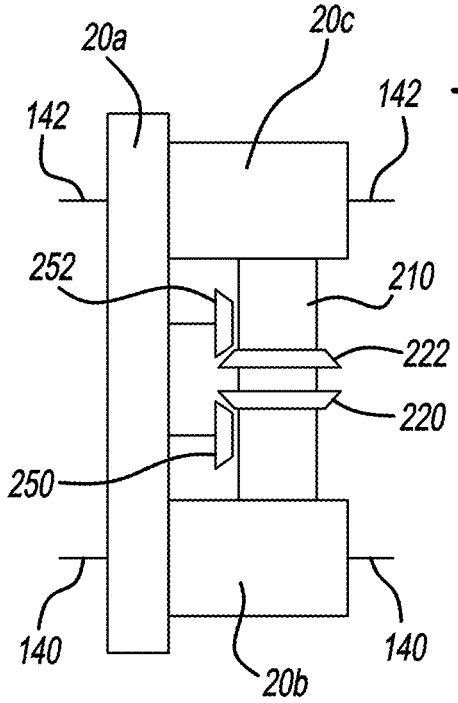
FIG. 7 shows a plan schematic view of the single-cylinder engine embodiment shown in FIGS. 1-6.

FIG. 7 shows a plan schematic view of the single-cylinder engine embodiment shown in FIGS. 1-6. FIGS. 8, 9, 10, and 11 show plan schematic views of alternative engine structures incorporating components similar to those shown in FIG. 7 and in FIGS. 1-6.

Figure 11:
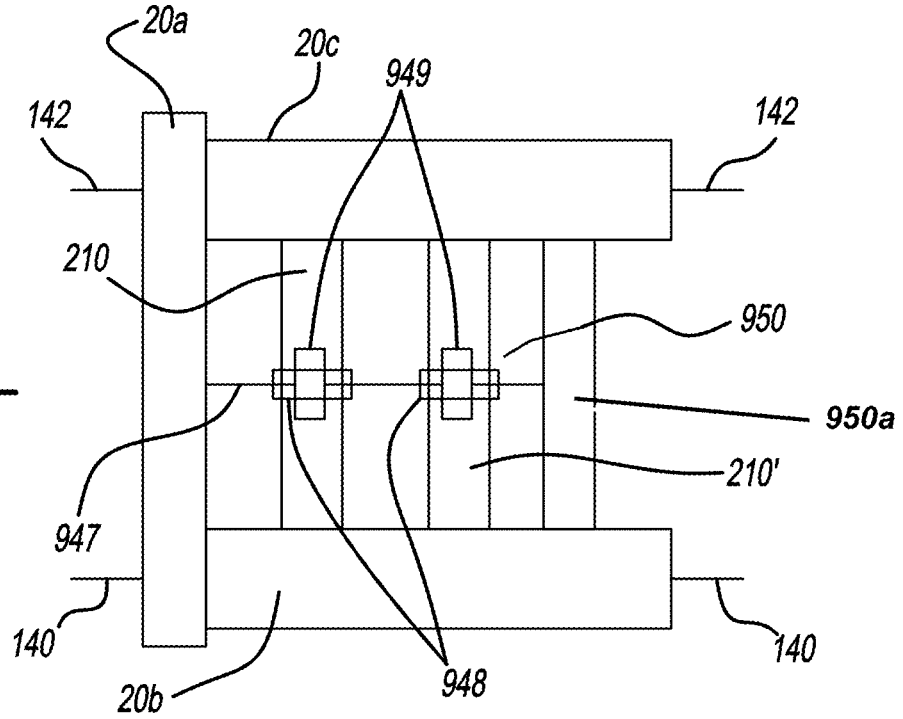
FIG. 11 shows a plan schematic view of another alternative engine structure incorporating components similar to those shown in FIGS. 1-7.
Figure 38:
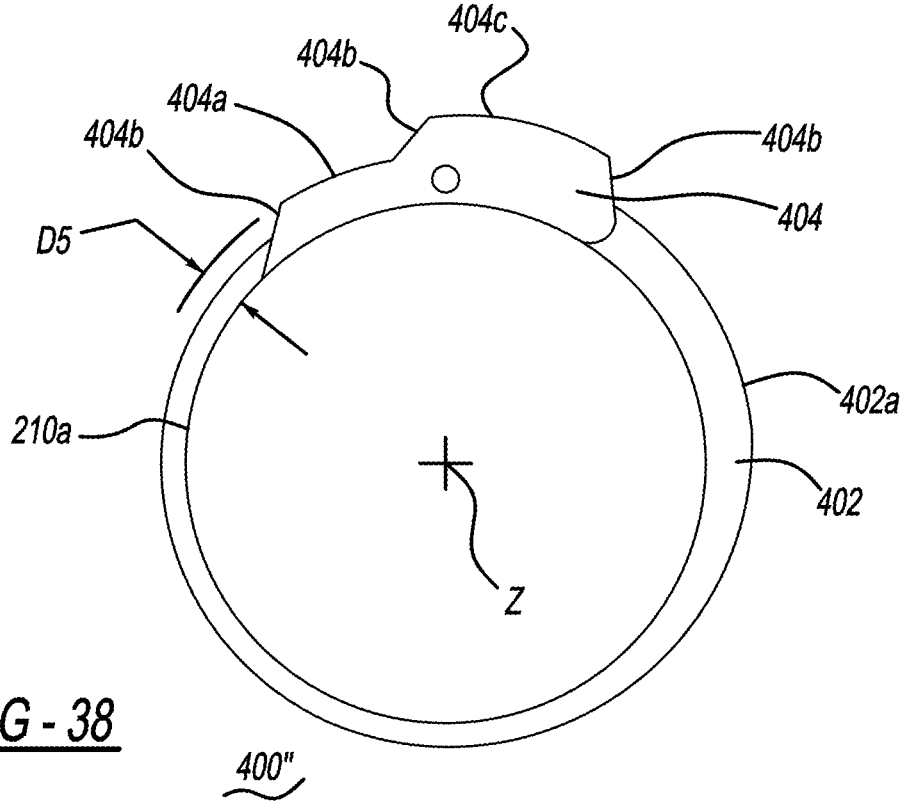
FIG. 38 is a side view of another embodiment of a camming element incorporated into an embodiment of the engine to actuate an associated valve assembly.

In one embodiment, as shown in FIG. 11, housing second and third portions 20*b* and 20*c* may be lengthened and/or otherwise configured for receiving therein and supporting a lengthened crankshaft (not shown) as well as one or more additional engine cylinders 210' and additional associated set(s) of opposed pistons, piston rods, bearings, etc., thereby converting the engine from a single-cylinder engine to a two-cylinder engine (or a multi-cylinder engine) and enabling an increase in the power generated by the engine. In this embodiment, a worm gear mechanism 950 including elements such as worms 949 and complementary worm gears 948 are provided to rotate associated camming elements (not shown) rotatably mounted on cylinders 210 and 210', as described herein. The worms 949 are mounted on shaft(s) 947 extending above and/or or below the cylinder and which are rotatably connected to engine housing first portion 20*a* and a brace 950*a* connected to second and third housing portions 20*b* and 20*c* for supporting the shaft 947. Shaft 947 is operatively coupled to gear train 112 (shown in FIGS. 2 and 2A, and described herein) such that rotation of one or more gears in the gear train produces rotation of the shaft. Rotation of shaft 947 produces rotation of worms 949 mounted thereon, which rotates the associated worm gears 948. The camming elements then rotate in conjunction with the associated worm gears to actuate the valve assemblies, as described herein.

In addition, an additional cylinder housing 310' (not shown in FIG. 11, but similar to cylinder housing 300 in FIGS. 2 and 53, and described in greater detail below) is provided to aid in securing cylinder 210' in position, and to permit the mounting of valve assemblies thereon as described herein. The cylinder housing 310' may be secured to the cylinder housing 310 (not shown) in which a portion of first cylinder 210 is mounted, to aid in positioning and holding the cylinder housing 310'. Alternatively, the cylinder housing 310' may be secured to housing portion 20*a*', to brace 950, or to any other suitable portion of the engine.

Figure 10:
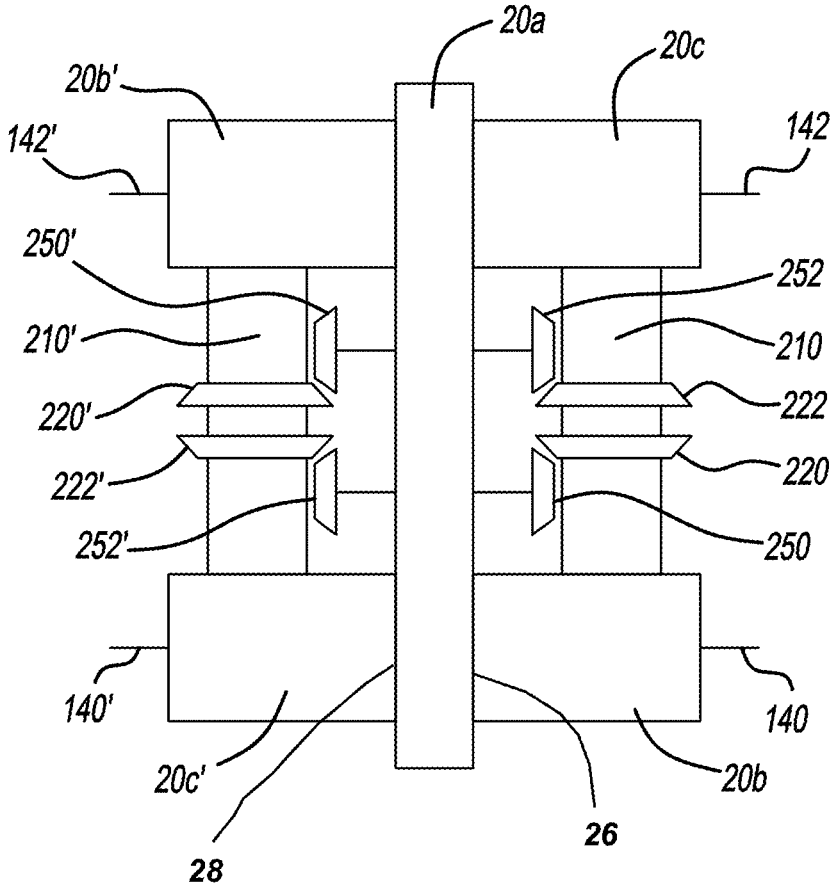
FIG. 10 shows a plan schematic view of another alternative engine structure incorporating components similar to those shown in FIGS. 1-7.

Referring to FIG. 10, in another embodiment, additional second and third housing portions 20*b*' and 20*c*' are attached to first housing portion second side 28 for receiving therein and/or supporting a lengthened crankshaft as well as one or more additional engine cylinders 210' and additional associated set(s) of opposed pistons, piston rods, bearings, etc., on an opposite side of the gear train 112 in housing portion 20*a*, thereby converting the engine from a single-cylinder engine to a two-cylinder engine (or a multi-cylinder engine) and enabling an increase in the power generated by the engine.

In FIG. 10, bevel gears 250' and 252' are operatively coupled (via shafts) to gear train 112 in housing first portion 20*a* and also to complementary bevel gears 220' and 222' rotatably mounted on a cylinder 210' positioned on a side of the engine housing first portion 20*a* opposite the side of the housing along which cylinder 210 is positioned. In this embodiment, gears 250' and 252' rotate bevel gears 220' and 222' mounted on cylinder 210', thereby actuating valves (not shown) coupled to the cylinder, for controlling the combustion cycle in cylinder 210' as described herein. In this manner, a single gear train 112 (not shown) mounted in engine housing first portion 20*a* can be used to actuate valves mounted on multiple engine cylinders, and/or mounted on cylinders located along opposite sides of the gear train 112.

In addition, an additional cylinder housing 310' (not shown, but similar to cylinder housing 310 described herein) is provided to aid in securing cylinder 210' in position, and to permit the mounting of valve assemblies thereon as described herein. The cylinder housing 310' may be secured to housing portion 20*a* or to any other suitable portion of the engine, to aid in positioning and holding the cylinder housing 310'.

Figure 9:
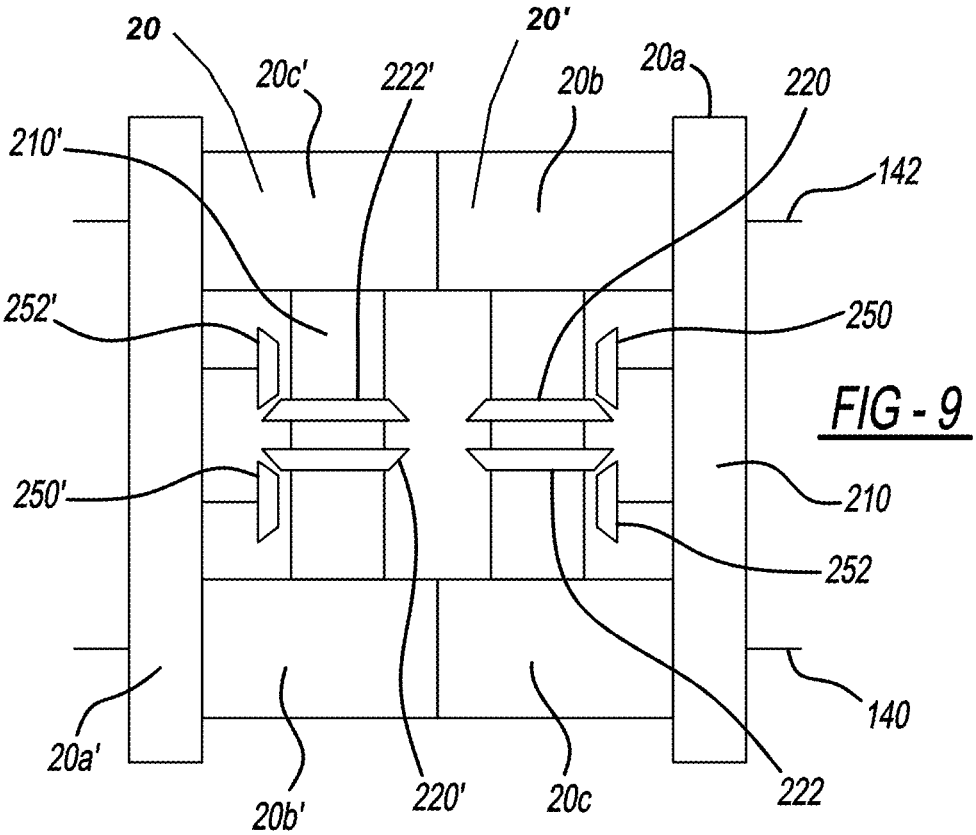
FIG. 9 shows a plan schematic view of another alternative engine structure incorporating components similar to those shown in FIGS. 1-7.

Referring to FIG. 9, in another embodiment, two engine housings 20 and 20' similar to housing 20 shown in FIGS. 1-6 are secured to each other as shown. In this embodiment, first housing portions 20*a* and 20*a'* are secured at each end of the engine, while multiple housing second portions 20*b*, 20*b'* and third portions 20*c*, 20*c'* extend between and are secured between the housing first portions. In this arrangement, the housing second portions 20*b*, 20*b'* and third portions 20*c*, 20*c'* support and/or contain therein the engine cylinders, pistons, piston rods, valves, crankshafts and other associated components needed for operation of the engine, as previously described. Second portions 20*b*, 20*b'* and third portions 20*c*, 20*c'* may be formed as single pieces, as previously described with regard to FIG. 11.

In addition, bevel gears 250' and 252' are operatively coupled (via shafts) to a gear train 112' in housing portion 20*a'* and also to complementary bevel gears 220' and 222' rotatably mounted on an associated cylinder 210'. Also, bevel gears 250 and 252 are operatively coupled (via shafts) to a gear train 112 in housing portion 20*a* and also to complementary bevel gears 220 and 222 rotatably mounted on an associated cylinder 210. In this embodiment, gears 250' and 252' rotate bevel gears 220' and 222' mounted on cylinder 210', thereby actuating valves (not shown) coupled to the cylinder, for controlling the combustion cycle in cylinder 210' as described herein. Also, gears 250 and 252 rotate bevel gears 220 and 222 mounted on cylinder 210, thereby actuating valves (not shown) coupled to the cylinder, for controlling the combustion cycle in cylinder 210 as described herein. Gears 220 and 222 may be rotatably mounted on the exterior of cylinder 210 using suitable bearings or any other suitable method.

In addition, an additional cylinder housing 310' (not shown, but similar to cylinder housing 310 described herein) is provided to aid in securing cylinder 210' in position, and to permit the mounting of valve assemblies thereon as described herein. The cylinder housing 310' may be secured to the cylinder housing 310 (not shown) in which a portion of first cylinder 210 is mounted, to aid in positioning and holding the cylinder housing 310'. Alternatively, the cylinder housing 310' may be secured to housing portion 20*a'* or to any other suitable portion of the engine.

Figure 8:
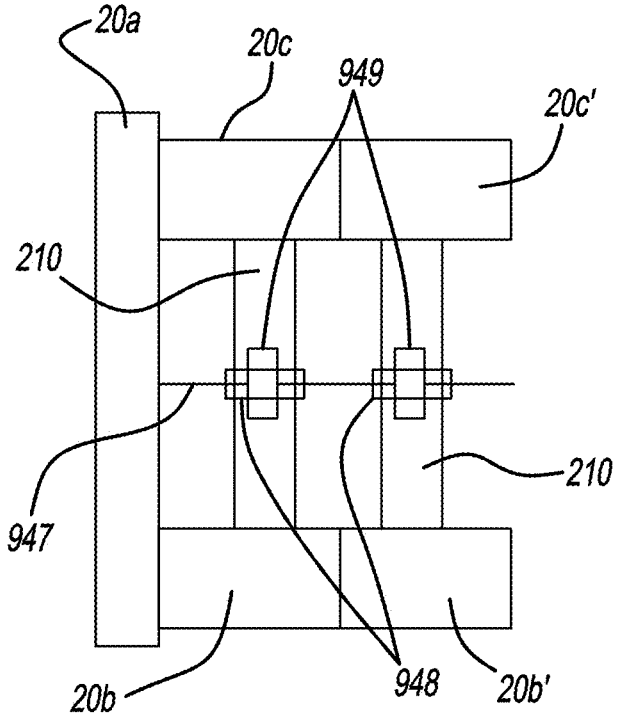
FIG. 8 shows a plan schematic view of an alternative engine structure incorporating components similar to those shown in FIGS. 1-7.

In the embodiment shown in FIG. 8, additional second and third housing portions 20*b'* and 20*c'* are attached to second and third portions 20*b* and 20*c*, respectively, of a housing configured as shown in FIG. 7 and in FIGS. 1-6. Second and third portions 20*b'* and 20*c'* support a second cylinder 210' and associated engine components as described herein. The valve assemblies (not shown) are actuated using a worm gear system operatively coupled to a gear train 112 (not shown) positioned within housing portion 20*a* as previously described with regard to FIG. 11. This configuration provides a multi-cylinder engine similar to that shown in FIG. 11. It may be seen that any desired number of additional second and third housing portions 20*b* and 20*c* may be attached to the base engine housing 20 to support any desired number of associated cylinders 210 and related engine components, enabling the number of cylinders (and the associated engine power) to be increased in a modular fashion.

In addition, an additional cylinder housing 310' (not shown) is provided to aid in securing cylinder 210' in position, and to permit the mounting of valve assemblies thereon as described herein. The cylinder housing 310' may be secured to the cylinder housing 310 (not shown) in which a portion of first cylinder 210 is mounted, to aid in positioning and holding the cylinder housing 310'. Alternatively, the cylinder housing 310' may be secured to housing portion 20*a* or to any other suitable portion of the engine.

In the embodiment shown in FIGS. 1-6, first housing portion 20*a* is structured to enclose and support four gears as shown. In another embodiment (not shown), first housing portion may have a different configuration designed to accommodate a greater or lesser number of gears and/or a collection of meshing gears in a spatial arrangement different from that shown in FIGS. 1-6. Thus, the configuration of the first housing may be adapted to accommodate the gearing requirements of a particular end-use.

In yet another embodiment, housing first portion 20*a* serves as a base to which one or more second housing portion(s) 20*b*, third housing portion(s) 20*c*, and other portions of the engine housing and engine may be attached, but without an associated gear train mounted therein.

The engine housing 20 can be secured to a vehicle frame or to another portion of the vehicle in a conventional manner, using bolts, welds, or any other suitable mechanism.

Due to the modular design of the structure of the engine housing 20, the housing structure may be adapted to incorporate any desired number of cylinders, depending on the power requirements of the engine. By attaching additional housing second and third housing portions to existing second and third housing portions, respectively, or by attaching additional housing second and third housing portions to existing first housing portions, the engine housing can be made to accommodate additional cylinders, thereby increasing the power generated by the engine. In addition, any desired number of housing first portions 20*a* (either with or without gear trains or other elements incorporated therein) may be positioned at ends of the housing or between cylinders of the engine, in order to position gear trains in desired locations within the engine envelope or to provide rigidity to the engine housing structure.

Referring to FIGS. 1-6, 12-30, and 52, a cylinder housing 300 is incorporated into (or rigidly coupled to) engine housing 20 and/or to another portion of the engine to provide a receptacle for a cylinder 210 mounted therein. Cylinder housing 300 defines a central cavity 300*a* in which cylinder 210 (described in greater detail below) is received. In addition, cylinder housing 300 includes at least one opening 300*b* formed in a wall of the housing to serve as an intake port, enabling a flow of combustion air into the interior of the cylinder during an intake portion of a combustion cycle. Cylinder housing 300 also includes at least one opening 300*d* (not shown) separate from opening 300*b*, and formed in a wall of the cylinder housing to serve as an exhaust port, enabling a flow of exhaust and combustion by-products out of the interior of the cylinder during an exhaust portion of the combustion cycle. Cylinder housing 300 may be bolted or welded to engine housing 20. Alternatively, other attachment methods may be used.

Figure 52:
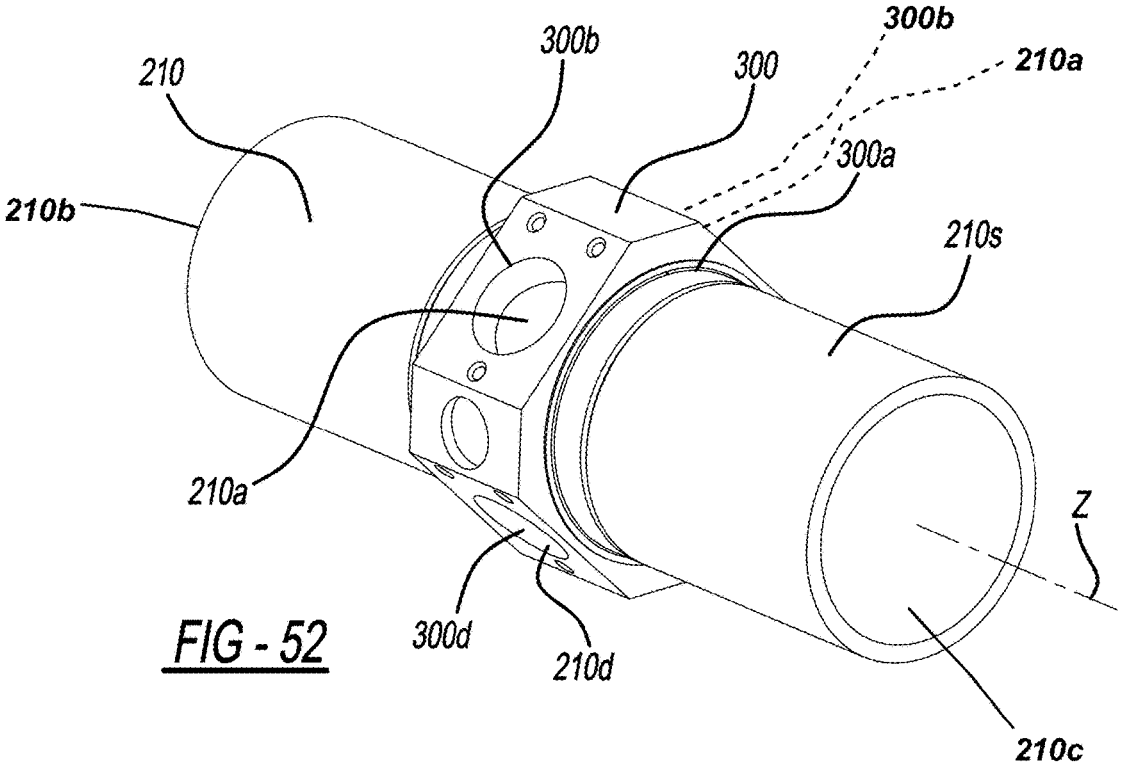
FIG. 52 is a perspective view of a cylinder housing with a cylinder incorporated therein, in accordance with an embodiment of the present invention.

In the embodiment shown in FIGS. 1-6 and 12-30, cylinder housing 300 includes two intake openings 300*b* formed along an upper surface of the cylinder housing and having central axes oriented at about 90 degrees with respect to each other. The cylinder housing 300 of FIGS. 1-6 and 12-30 also includes a single exhaust opening 300*d* formed along a lower surface of the cylinder housing and oriented at about 90 degrees with respect to one of the intake openings. Also, in the embodiment shown, the central axes of intake openings 300*b* and exhaust openings 300*d* are coplanar. In a particular embodiment, central axes of the intake openings 300*b* are coplanar along a plane extending substantially perpendicular to a longitudinal central axis Z of the central cavity 300*a*. In a particular embodiment, axis Z is also a longitudinal central axis of a cylinder 210 positioned in the central cavity as shown in FIG. 52.

Intake opening(s) 300*b* and exhaust opening(s) 300*d* in cylinder housing 300 are aligned with corresponding intake opening(s) 210*a* and exhaust opening(s) 210*d* formed in cylinder 210 (described below). In a particular embodiment, a central axis of the exhaust opening 300*d* is coaxially aligned with a central axis of one of intake openings 300*b*, thereby providing a straight-line path for gases flowing into the intake opening 300*b*, into and through the combustion chamber formed by cylinder 210, and out of the combustion chamber through exhaust opening 300*d*.

While FIGS. 1-6 and 12-30 show one particular arrangement of intake and exhaust openings formed in an exemplary cylinder housing, any desired number of intake and exhaust openings may be provided, having any desired axial orientations with respect to each other and any desired spatial arrangement to meet the requirements of a particular engine configuration, depending on such factors as the geometry of the end-use envelope in which the engine is to be installed, the air and exhaust flow requirements for the desired combustion reaction, the type of valving used to control intake and exhaust flow, and other pertinent factors. Thus, central axes of the intake and exhaust openings may be oriented at less than or more than 90 degrees with respect to each other.

In a particular embodiment, central axes of one or more of intake opening(s) 300*b* and exhaust opening(s) 300*d* intersect a central axis Z of cylinder 210. Openings 300*b* and 300*d* and/or the structures of the cylinder housing surrounding the openings are configured such that the openings are sealable by suitable valve mechanisms 30, 32, 34 (described below) mounted on the cylinder housing and/or on engine housing 20, to prevent flow of gases therethrough during predetermined portions of the combustion cycle, as known in the art.

The structures of the cylinder housing 300 and the valve mechanisms also permit the seals to be opened during predetermined portions of the cycle to permit the intake of combustion air and the exhaust of combustion products, as known in the art. For example, in an internal combustion engine cycle including intake, compression, power, and exhaust strokes, the valves would be in a closed condition (i.e., configured to block passage of gases through the openings 300*b* and 300*d*) during the compression and power phases of the engine cycle, and one or more of the valves would be in a open condition (i.e., configured to permit flow through the openings) during the intake and exhaust phases of the cycle. One contemplated arrangement of openings 300*b* and 300*d* is shown in FIGS. 1-6.

Cylinder housing 300 may be formed from aluminum, an aluminum alloy, steel, or any other suitable material using known processes such as casting, boring and finish machining, for example.

Factors such as the number, sizes, shapes and locations of the openings 300*b* and 300*d* may be specified to meet the requirements of a particular engine design. For example, the number and/or sizes of the openings 300*b* and 300*d* may be specified so as to provide a desired volumetric flowrate of air and/or exhaust gases for a given engine cycle. Also, the locations, shapes, and other characteristics of the openings and their surrounding structures may be specified so as to enable the use of valves of a certain type or to enable the mounting of the valves at desired locations along the cylinder housing.

In addition, the structure of the cylinder housing proximate openings 300*b* and 300*d* may be configured to facilitate mounting of the valve mechanisms 30, 32, 34 on the housing. The particular mounting structures of the portions of the cylinder housing proximate the openings may depend on the types of valve mechanisms to be incorporated into the engine. In one embodiment (shown in FIGS. 1-6 and 12-30), conventional throttle valves 38, 40 are used to regulate the amount of airflow into the intake ports 300*b*, while poppet valve mechanisms 30, 32, 34 (as described below) are used to block and unblock the intake and exhaust ports at appropriate points in the engine cycle. Other types of valves are also contemplated.

In one embodiment, an opening 300*s* is provided in cylinder housing 300 to permit fluid communication between an ignition source or sources 42 (for example, one or more conventional spark plugs) and the interior of the cylinder 210, thereby providing a means for igniting the fuel-air mixture residing in the cylinder 210. The ignition source may be mounted on the cylinder housing or on engine housing 20 using any of a variety of known methods. The ignition source generates a spark at an appropriate point in the engine cycle for igniting an air-fuel mixture in the cylinder combustion chamber, in a manner known in the art. In embodiments where a conventional spark plug is used, the spark plug may be coupled to a conventional distributor for controlling voltage to the spark plug, in a manner known in the art.

In another embodiment, the cylinder housing 300 is configured to incorporate statically mounted elements of the ignition source described in U.S. Pat. No. 7,448,352, the disclosure of which is incorporated herein by reference. Referring to FIGS. 12-30, in one embodiment, a delivery conductor 44 and ground conductor 46 of the ignition source are mounted in the cylinder 210. An engine control unit (ECU) (not shown) or other device may be used to control direction of an electric current to the delivery conductor at an appropriate point in the internal combustion engine cycle, thereby causing a spark to be generated in the space between the delivery and ground conductors. This spark ignites the air-fuel mixture, initiating the power phase of the combustion cycle as known in art and as described in the abovementioned U.S. patent. In this embodiment, the face of each of pistons 120 and 130 (or the face of any spacer attached to a piston) may include a slot or groove (not shown) formed therein and configured for providing a clearance between the piston face and the delivery and ground conductors, as the pistons approach each other within the cylinder. Alternatively, the embodiment shown in FIGS. 12-30 may be implemented using a conventional spark plug as previously described, with the delivery conductor 44 and ground conductor 46 omitted.

Other ignition sources suitable for the purposes described herein are disclosed in U.S. patent application Ser. Nos. 12/288,872 and 12/291,326, the disclosures of which are all incorporated herein by reference. Other types of ignition sources are also contemplated.

An opening 22*f* is also provided in the cylinder housing 22 to enable a conventional fuel-injection mechanism 103 (for example, a direct injection or port injection mechanism) to inject atomized fuel into one or more of intake ports 22*b* during the engine cycle.

Figure 2:
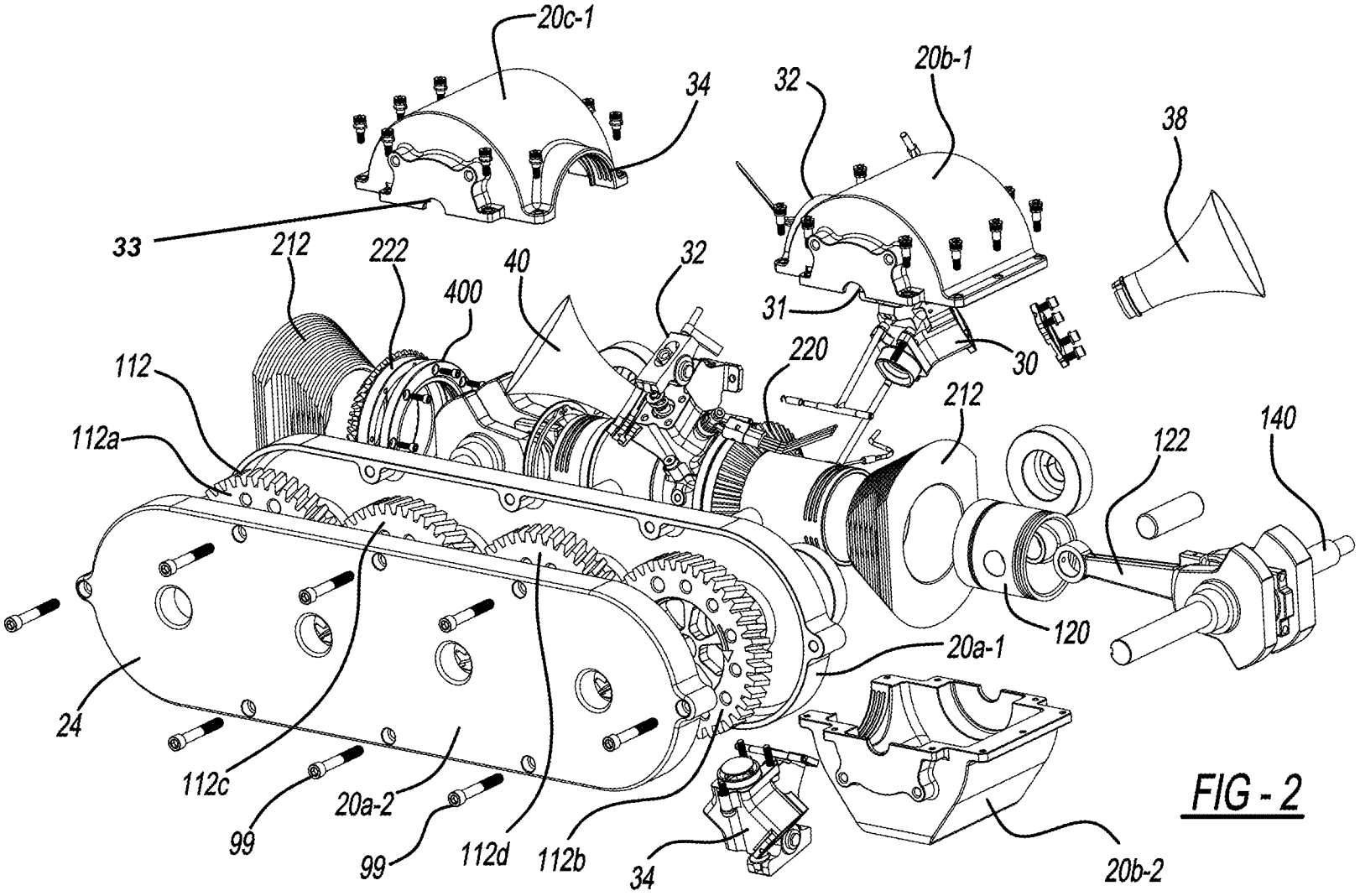
FIG. 2 is an exploded perspective view of the engine embodiment shown in FIG. 1.
Figure 2A:
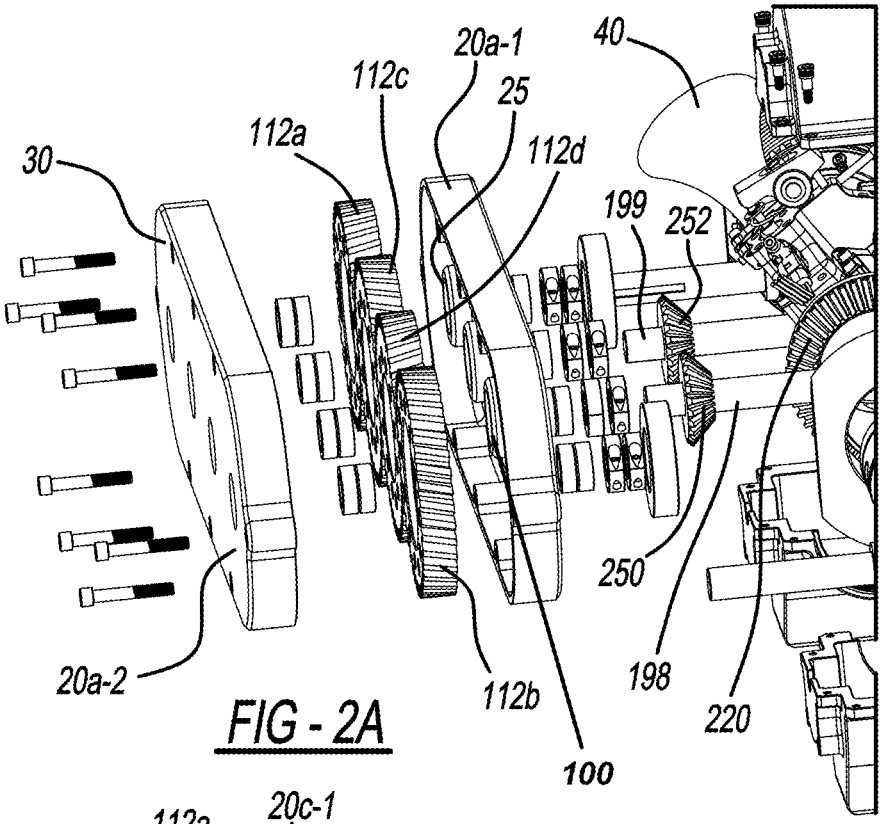
FIG. 2A is an alternative exploded perspective view of a portion of the engine embodiment shown in FIG. 2.
Figure 2B:
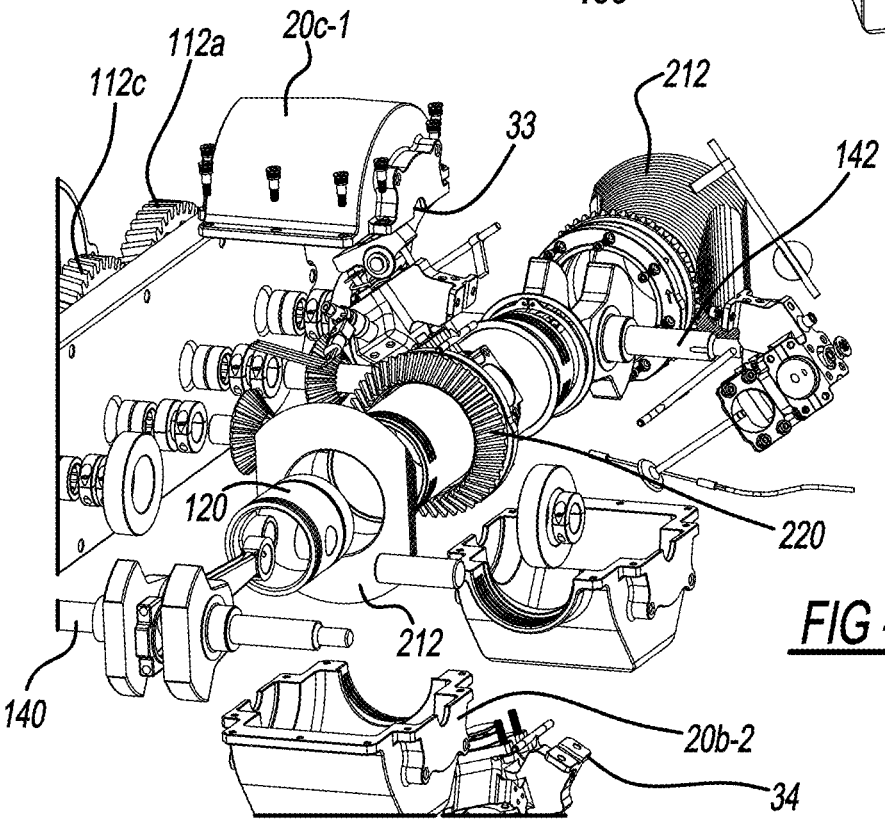
FIG. 2B is another alternative exploded perspective view of a portion of the engine embodiment shown in FIG. 1.
Figure 3:
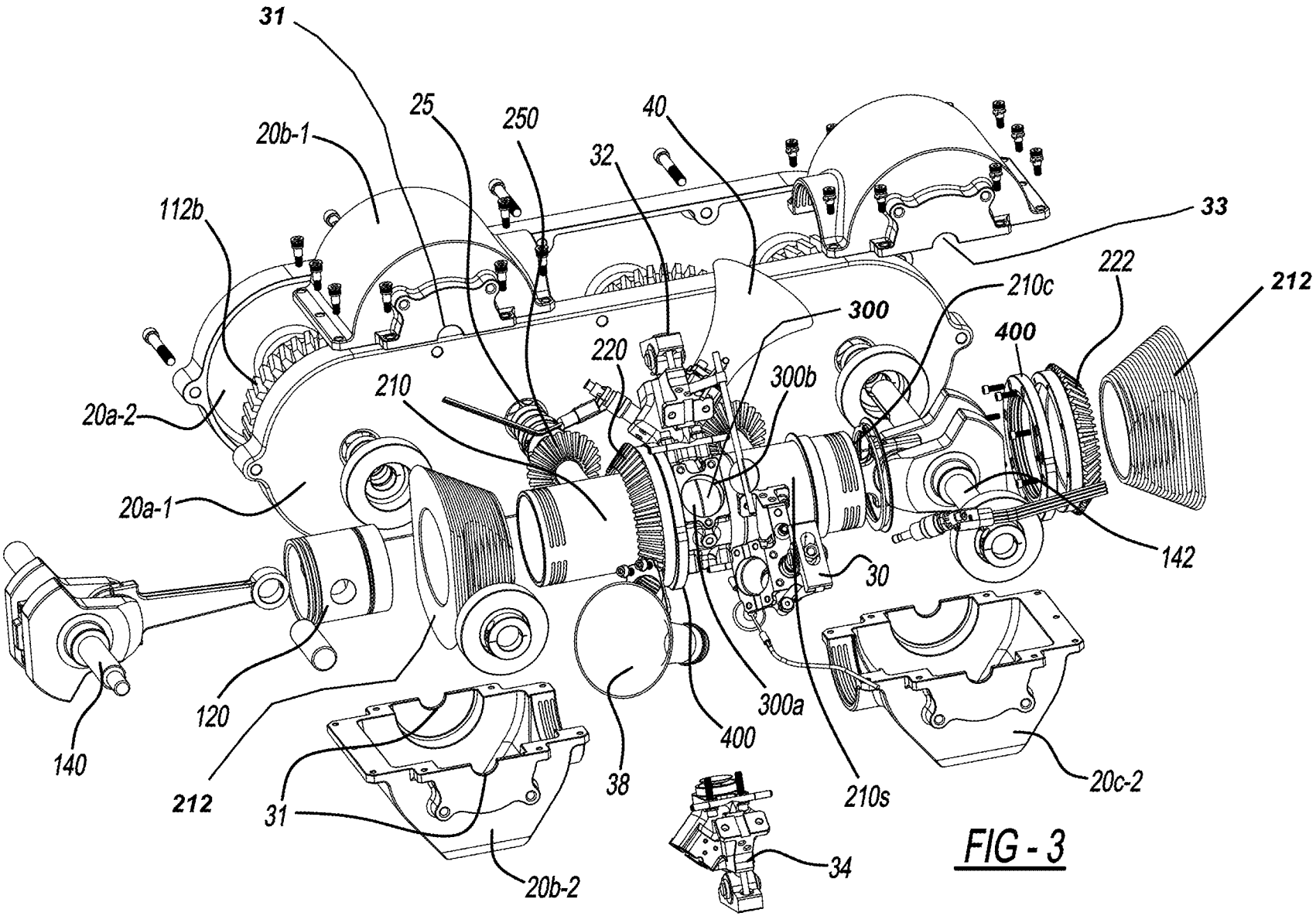
FIG. 3 is another alternative exploded perspective view of the engine embodiment shown in FIG. 1.
Figure 4:
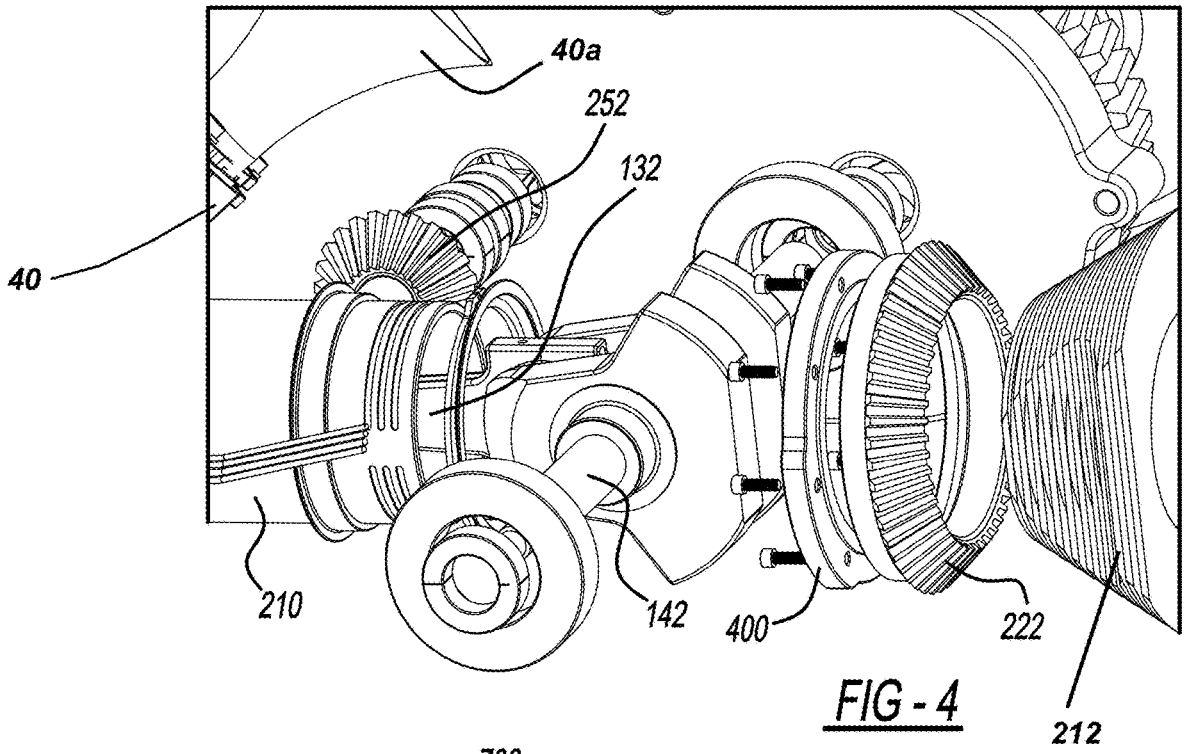
FIG. 4 is an exploded perspective view of a portion of the engine embodiment shown in FIG. 1.
Figure 5:
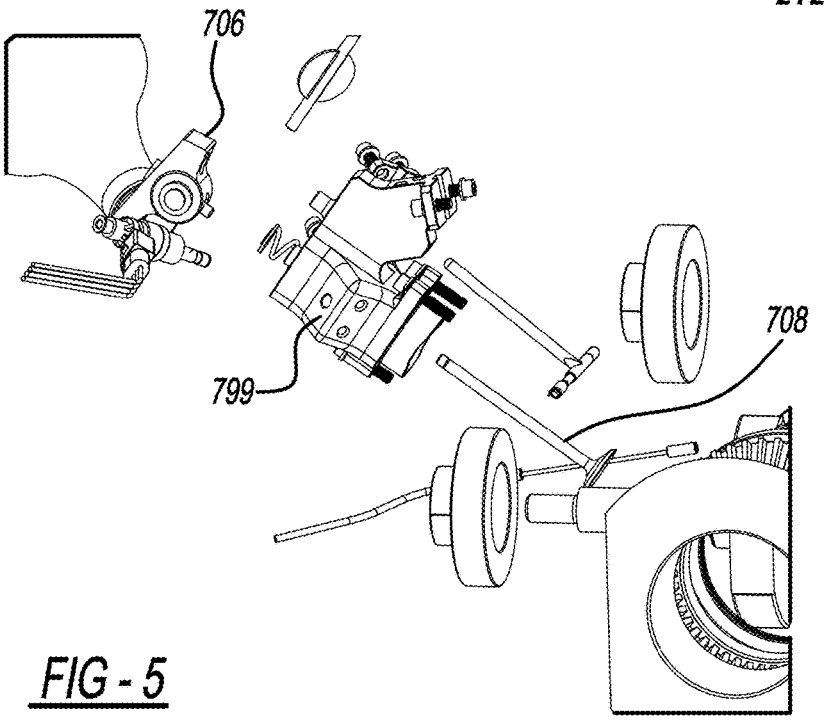
FIG. 5 is an exploded perspective view of another portion of the engine embodiment shown in FIG. 1.
Figure 6:
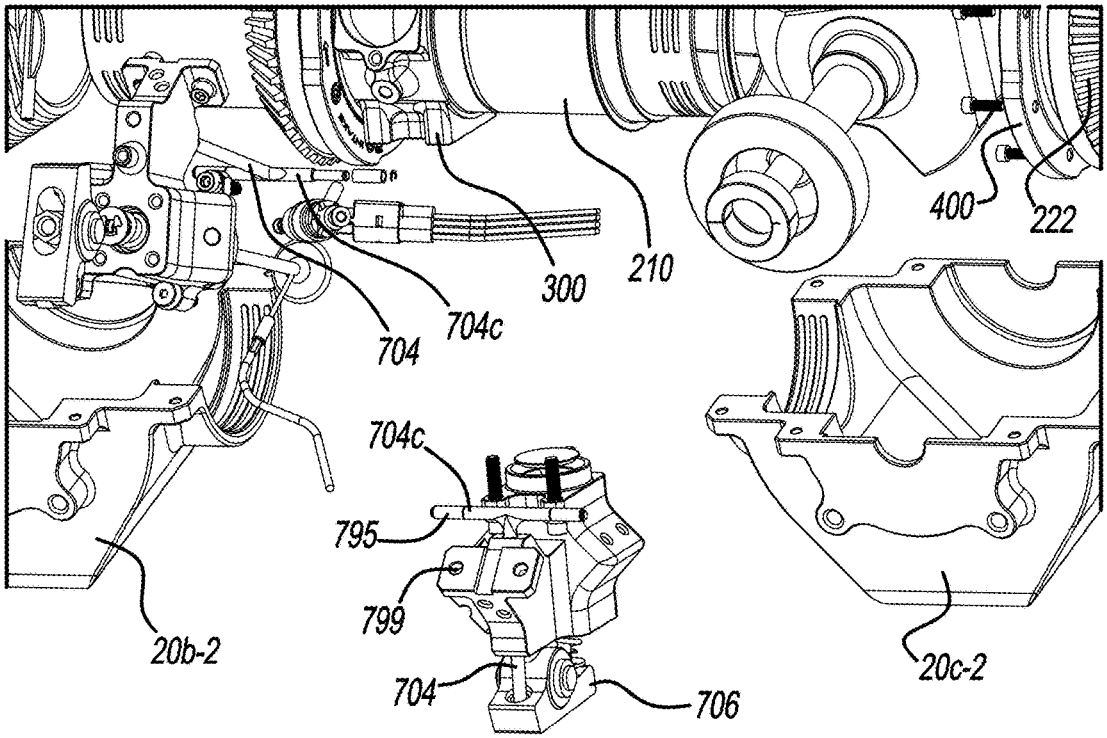
FIG. 6 is an exploded perspective view of another portion of the engine embodiment shown in FIG. 1.

Referring to FIGS. 1, 3 and 52, cylinder 210 has an exterior surface 210*s*, a first open end 210*b*, a second open end 210*c*, and a plurality of openings located proximate a center of the length of the cylinder to enable flow of air-fuel mixture into (and exhaust gases out of) the cylinder interior. In one embodiment, cylinder 210 forms (in conjunction with opposed pistons 120 and 130 (not shown) disposed within the cylinder) a combustion chamber for the air-fuel combustion reaction. Thus, a single cylinder houses both pistons 120 and 130 of an opposed piston pair. Cylinder 210 is supported at each end by an associated brace 212 mounted to a respective one of housing second portion 20*b* and housing third portion 20*c*. Also, the cylinder is supported within and by cylinder housing 300. One or more through openings 210*a* are provided in the wall of the cylinder to permit the flow of air and fuel into (and the flow of exhaust gases from) the cylinder interior via the cylinder housing intake and exhaust ports 300*b* and 300*d*. In a particular embodiment, opening(s) 210*a* are located midway between the ends of the cylinder. The opening(s) 210*a* may have any suitable shape(s). In one particular embodiment, the openings extend a maximum of twelve inches from a plane extending perpendicular to a central longitudinal axis L of the cylinder and bisecting the cylinder.

Opening(s) 210*a* are configured to align with intake port(s) 300*b* and exhaust port(s) 300*d* of cylinder housing 300 when the cylinder is mounted in the cylinder housing, so that appropriate actuation of the valves controlling gas flow through openings 300*b* and 300*d* will permit introduction of fuel/air mixture and egress of exhaust gases during operation of the engine, in the manner described below. The cylinder 210 may be formed from any suitable material using any suitable fabrication method or methods.

In the embodiment shown in FIGS. 1-6 and 12-30, cylinder 210 includes two intake openings 210*a* formed along the cylinder and having central axes oriented at about 90 degrees with respect to each other. The cylinder 210 of FIGS. 1-6 also includes a single exhaust opening 210*d* formed along a lower surface of the cylinder and oriented at about 90 degrees with respect to one of the intake openings. Also, the central axes of intake openings 210*a* and exhaust openings 210*d* are coplanar.

In a particular embodiment, a central axis of the exhaust opening 210*d* is coaxially aligned with a central axis of one of intake openings 210*b*, thereby providing a straight-line path for gases flowing into the intake opening 210*b*, into and through the combustion chamber formed by cylinder 210, and out of the combustion chamber through exhaust opening 210*d*.

While FIGS. 1-6 and 12-30 show one particular arrangement of intake and exhaust openings formed in an exemplary cylinder, any desired number of intake openings 210*a* and exhaust openings 210*d* may be provided, having any desired axial orientations with respect to each other and any desired spatial arrangement to meet the requirements of a particular engine configuration, depending on such factors as the geometry of the end-use envelope in which the engine is to be installed, the air and exhaust flow requirements for the desired combustion reaction, the type of valving used to control intake and exhaust flow, and other pertinent factors. Thus, central axes of the intake and exhaust openings may be oriented at less than or more than 90 degrees with respect to each other.

In a particular embodiment, central axes of one or more of intake opening(s) 210*b* and exhaust opening(s) 210*d* intersect a longitudinal central axis Z (FIG. 52) of cylinder 210.

Factors such as the number, sizes, shapes and locations of the cylinder openings 210*a* may be specified to meet the requirements of a particular engine design. For example, the number and/or sizes of the openings may be specified so as to provide a desired volumetric flowrate of air and/or exhaust gases for a given engine cycle. Also, the locations, shapes, and other characteristics of the openings and their surrounding structures may be specified so as to facilitate the use of valves of a certain type or to enable the mounting of the vales at desired locations.

Figure 53:
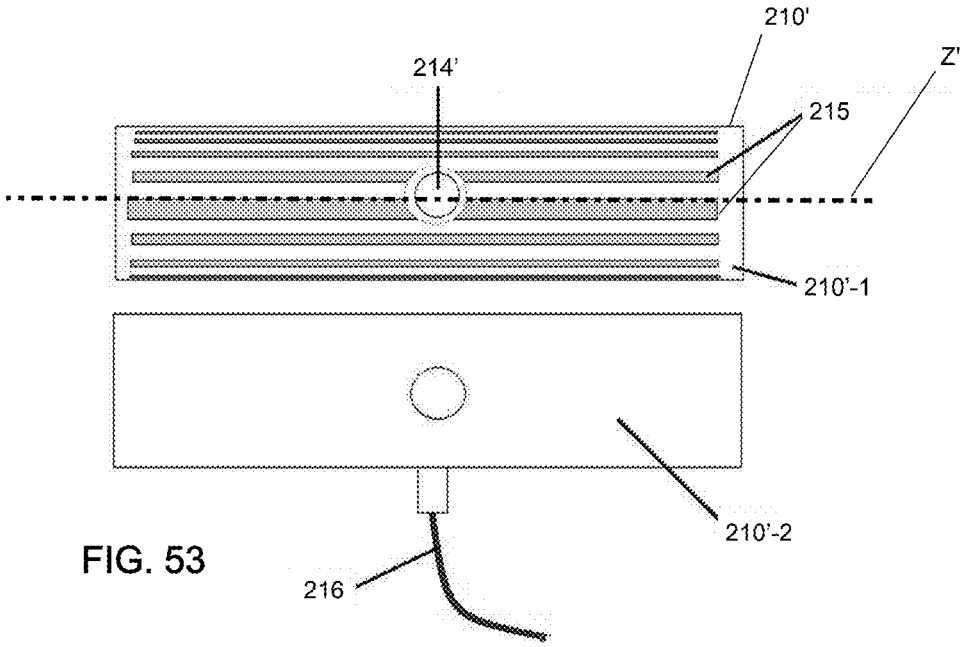
FIG. 53 is a side view of an inner cylinder portion and an outer cylinder portion of an alternative embodiment of a cylinder as described herein.
Figure 54:
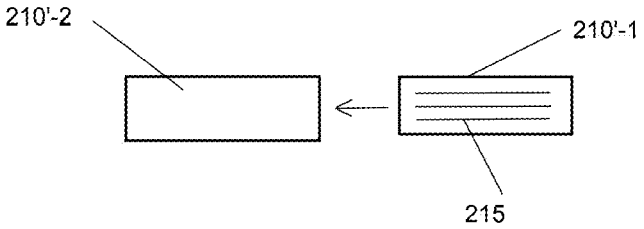
FIG. 54 is a schematic view showing insertion of the inner cylinder portion of FIG. 53 into the outer cylinder portion assembly of FIG. 53.

Referring to FIGS. 53 and 54, in an alternative embodiment, a cylinder 210' is provided which is functionally similar to the cylinder 210 previously described. Cylinder 210' is formed from an inner cylinder portion 210'-1 and an outer cylinder portion 210'-2 structured to receive the inner cylinder portion therein. Openings 214' (similar to openings 210*a* in previously-described cylinder 210) are provided in inner cylinder portion 210'-1 for use as intake and exhaust ports, openings for spark plugs, etc. Similarly, openings 218' (similar to openings 210*a* in previously-described cylinder 210) are provided in outer cylinder portion 210'-2 for use as intake and exhaust ports, openings for spark plugs, etc. Each opening 218' in outer cylinder portion 210'-2 is configured to align with a corresponding opening 214' in inner cylinder portion 210'-1, to enable access to the cylinder interior via the aligned openings.

A series of grooves 215 is formed along exterior surfaces of inner portion 210'-1. Grooves 215 serve as coolant passages and are configured to receive therein and permit a flow of a coolant (for example, a suitable oil or water-based coolant) along the cylinder for absorbing heat generated by fuel combustion and combustion products contained within the cylinder during engine operation. To close or seal the tops of the coolant passages, the exterior surface of inner portion 210'-1 and the outer cylinder portion 210'-2 are structured to contact each other along the regions surrounding the grooves. The grooves are configured to end at or extend around the various openings 214, if needed. In the embodiment shown in FIGS. 53 and 54, grooves 215 extend along the inner cylinder portion parallel to a longitudinal central axis Z' of the cylinder, although any of a variety of alternative groove patterns may be used according to the requirements of a particular application. In one embodiment, the grooves 215 are interconnected so that coolant can flow between adjacent grooves.

A feed line 216 provides a flow of coolant to one or more of grooves 215. A drain line (not shown) permits heated coolant to flow out of the network of grooves so that heat can be removed from the coolant using a known method, wherein the coolant can then be re-circulated through the cylinder via a recirculation system. In the embodiment shown, the coolant is introduced via feed line 216 to a central portion of the cylinder and into the grooves 215. In alternative embodiments, however, the coolant may be introduced into the grooves 215 at any portion therealong.

The cross-sectional shapes and dimensions of the grooves may be determined such factors as the heat transfer requirements for cooling the cylinder, the flow characteristics of the coolant, and other pertinent factors.

Suitable coolants may include oil-based or water-based coolants, or any other type of coolant suitable for the purposes described herein.

Referring to FIGS. 31-33 and 34-35, in particular embodiments, a heat exchange mechanism 500 is applied to an exterior of cylinder 210 to absorb heat generated by combustion reactions in the cylinder. Heat exchange mechanism 500 includes a generally annular inner portion 502 and a generally annular outer portion 504 overlying and spaced apart from the inner portion to form a coolant cavity therebetween. In one embodiment, heat exchange mechanism 500 has a generally cylindrical configuration. However, the heat exchange mechanism 500 may be shaped according to the requirements of a particular application.

Inner portion 502 has a first surface 502*a* and a second surface 502*b* opposite the first surface. Inner portion first surface 502*a* is configured to engage an exterior surface 210*s* of cylinder 210 so as to provide intimate contact with the cylinder exterior to aid in maximizing the efficiency of heat transfer from the cylinder 210 to the inner portion 502. Inner portion 502 may be secured in contact with cylinder 210 using any suitable means. For example, the inner portion 502 may be bolted to a portion of the cylinder housing or to the engine housing such that first surface 502*a* is secured in intimate contact with the cylinder. Alternatively, the inner portion 502 may be attached directly to the cylinder. In a particular embodiment, an end of inner portion 502 may be configured to overlap or cover an associated one of bevel gears 220, 222 mounted on cylinder 210.

Inner portion second surface 502*b* may have features formed thereon for maximizing the area for heat transfer from the inner portion. In one embodiment, shown in FIG. 31, these features are in the form of a plurality of spaced apart fin elements 502*c* extending in directions generally perpendicular to an exterior surface of cylinder 210.

Figure 32:
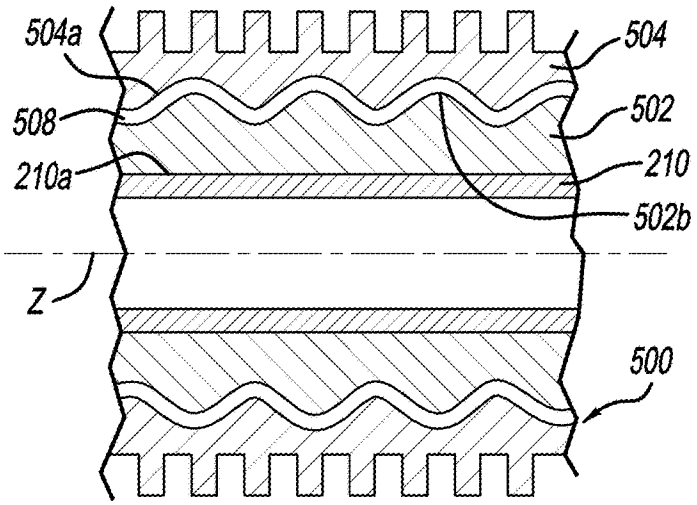
FIG. 32 is a cross-sectional view of a heat exchange mechanism in accordance with another embodiment of the present invention.

In another embodiment, shown in FIG. 32, the second surface 502*b* is formed into an undulating configuration, such that the distance of the second surface 502*b* from the cylinder 210 varies smoothly according to a predetermined pattern.

Figure 33:
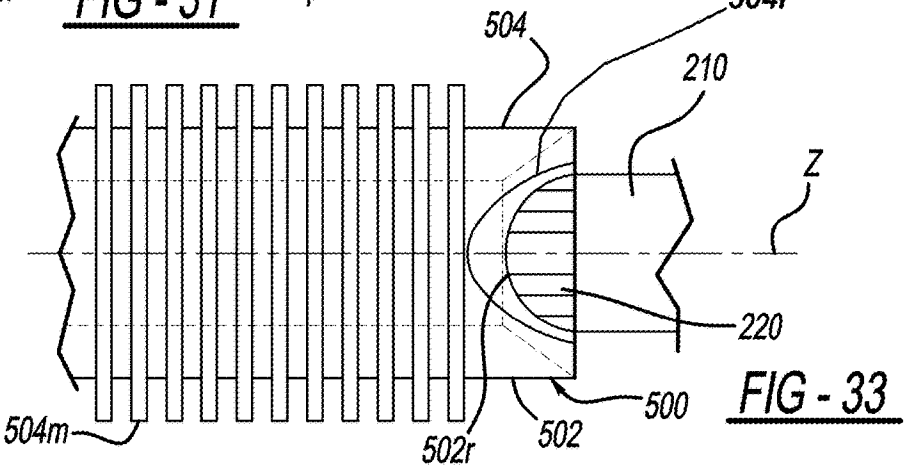
FIG. 33 is a side view of a portion of an exterior of a particular embodiment the heat exchange mechanism shown in one of FIGS. 31 and 32.
Figure 34:
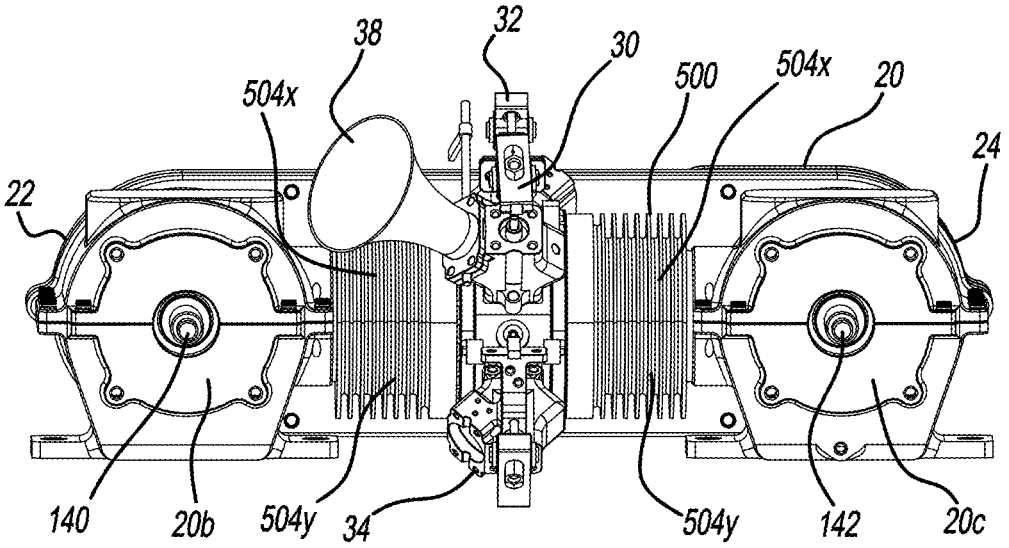
FIG. 34 is a side view of the engine of FIGS. 1-7 incorporating a heat exchange mechanism in accordance with one of the embodiments shown in FIGS. 31 and 32 attached to a cylinder of the engine.
Figure 35:
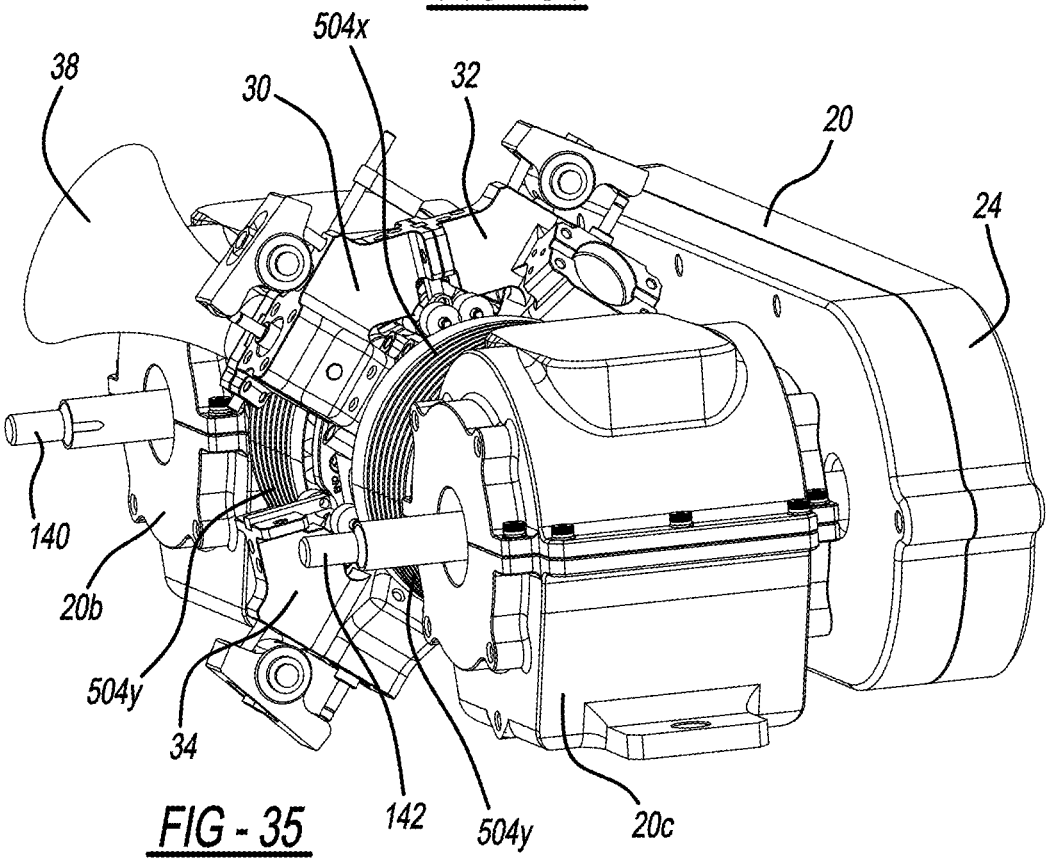
FIG. 35 is a perspective view of the engine embodiment shown in FIG. 34.

In addition, referring to FIG. 33, a recess 502*r* may be formed at an end of the inner portion 502 that is to be positioned along cylinder 210 proximate an associated one of one of bevel gears 220 and 222, to provide unobstructed access to the gear by one of meshing gears 250, 252. This recess enables the gear to be engaged and rotated by the complementary bevel gear 250 and 252, as described below.

In a particular embodiment (not shown), inner portion 502 is formed in two or more sections which are brought together to enclose and contact the portion of cylinder 210 to be covered. The inner portion sections are then secured to each other and/or to the cylinder and/or engine housing. For example, the inner portion 502 may be split into an upper section and a lower section which brought together and secured to enclose the portion of cylinder 210 to be covered. The inner portion 502 may also be formed in more than two sections if desired.

Also, outer portion 504 has a first surface 504*a* and a second surface 504*b* opposite the first surface. First surface 504*a* is spaced apart from inner portion second surface 502*b* so as to form a coolant cavity 508 therebetween. An end of outer portion 504 may be configured to overlap or cover an associated one of bevel gears 220, 222 mounted on cylinder 210.

Figure 31:
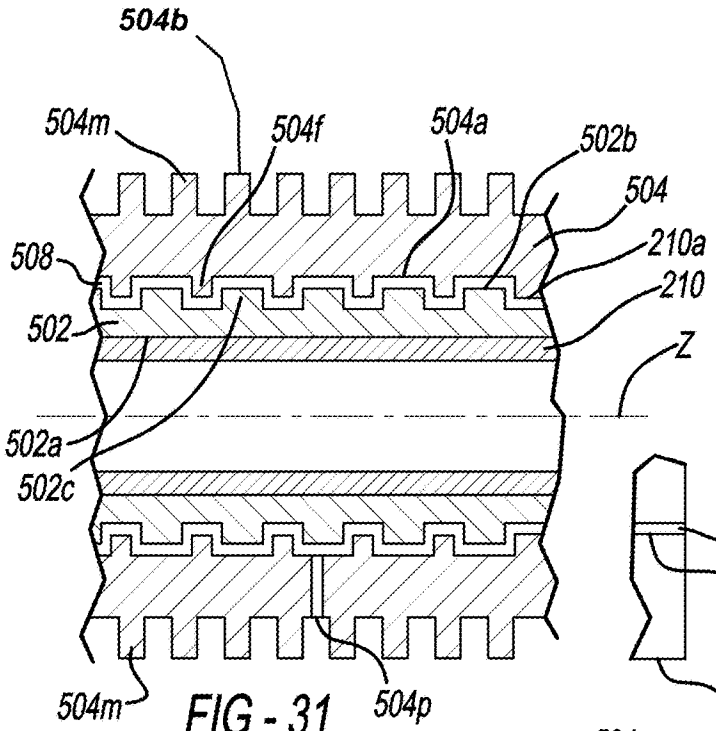
FIG. 31 is a cross-sectional view of a heat exchange mechanism in accordance with one embodiment of the present invention.

In one embodiment, shown in FIG. 31, the outer portion first surface 504*a* includes a plurality of spaced apart interior fin elements 504*f* extending in directions generally perpendicular to an exterior surface of cylinder 210. Fin elements 504*f* are arranged such that each of the fin elements is nested between adjacent ones of fin elements 502*c* extending from inner portion second surface 502*b* when the inner and outer portions 502 and 504 are mounted on the engine and secured with respect to each other. In addition, second surface 504*b* has a plurality of spaced apart external fin elements 504*m* formed therealong to facilitate heat transfer from the heat exchange mechanism 500 to external air.

In another embodiment, shown in FIG. 32, the outer portion first surface 504*a* is formed into an undulating pattern which complements the pattern formed onto the inner portion second surface 502*b* also shown in FIG. 32.

The geometries of inner portion second surface 502*b* and outer portion first surface 504*a* can be tailored using known methods to facilitate optimum heat transfer from the cylinder according to the requirements of a particular application, taking into account such factors as the flow rate of coolant through the coolant passage, the heat capacity of the coolant, the dimensions of the coolant passage, the materials from which the inner and outer portions are formed, the amount of heat generated by combustion in the cylinder, and other pertinent factors.

In addition, a recess 504*r* may be formed at an end of the outer portion 504 that is to be positioned along cylinder 210 proximate an associated one of bevel gears 220, 222, to provide unobstructed access to the gear. This recess enables the gear to be engaged and rotated by an associated one of complementary bevel gears 250, 252, as described below.

In addition, referring to FIG. 31, one or more coolant entry port(s) 504*p* extend through outer portion 504 and provide access to coolant passage 508 for a coolant material. Port(s) 504*p* provide a path for a coolant material 510 introduced from an exterior of the heat exchange mechanism 500 into the coolant cavity 508. In one embodiment, entry port 504*p* is positioned approximately midway between the ends of outer portion 504. However, the entry port(s) 504*p* may be positioned at any desired location(s).

Adjoining ends of inner portion 502 and outer portion 504 are coupled together so as to form a fluid-tight seal between the inner and outer portions at each end of the heat exchange mechanism 500. Also, one or more coolant exit ports 512 are formed in one or more of inner and outer portions 502 and 504 so as to provide fluid communication with coolant passage 508 to provide exits path(s) for coolant material flowing along coolant passage 508 between entry port(s) 504*p* and the exit port(s). This enables a flow of coolant to be maintained through the coolant passage to aid in transferring heat from the inner portion 502 to the fluid. However, the entry port 504*p* may be positioned at any desired location. In addition, the configuration of the walls of the coolant passage facilitates heat transfer from the coolant fluid to the outer portion 504, further facilitating heat transfer from the cylinder.

In an alternative configuration, one or more entry ports are positioned at an end of the heat exchange mechanism 500, and one or more exit ports are positioned at an opposite end of the heat exchange mechanism.

In a particular embodiment, outer portion 504 is formed in two or more sections 504*x* and 504*y* which are brought together to enclose and contact the portion of cylinder 210 to be covered. The outer portion sections are then secured to each other and/or to the cylinder and/or engine housing. For example, the outer portion 504 may be split into an upper section and a lower section which brought together and secured to enclose the portion of cylinder 210 to be covered. The outer portion may also be formed in more than two sections if desired.

The coolant material 510 may be in any suitable form, for example, water, a water-based fluid, oil, or any other suitable material. If desired, a fluid pump (not shown) for circulating coolant fluid through the coolant passage 508 may be operatively coupled to gear train 112 to power the pump.

Inner and outer portions 502 and 504 may have lengths suitable for covering any desired portion of cylinder 210. Inner and outer portions 502 and 504 may be formed from any suitable material or materials.

Referring again to FIGS. 1-6, opposed pistons 120 and 130 are connected via respective connecting rods 122 and 132 to respective crankshafts 140 and 142 mounted in engine housing 20 as described in U.S. Pat. No. 7,004,120. Pistons 120 and 130 reciprocate within cylinder 210 to rotate the crankshafts, in a manner known in the art. Each associated crankshaft and/or connecting rod is configured to aid in providing a predetermined stroke length to its associated piston residing within the cylinder. The opposed first and second pistons 120 and 130 may be of a relatively standard design, and may have predetermined lengths and predetermined diameters.

In one embodiment, the stroke length of each of pistons 120 and 130 is about 3 inches. Thus, the total difference between the spacing of the pistons at closest approach to each other (i.e., at "top dead center") and the maximum spacing of the pistons during the engine cycle (i.e., at "bottom dead center") is about 6 inches.

Optional first and second cylindrical spacers 122 and 132 (not shown) may be affixed to the faces of the associated pistons 120 and 130. The optional spacers 122 and 132 are not necessary but may be utilized to provide correct piston lengths for controlling spacing between the piston faces, thereby providing a means for adjusting the compression ratio and generally providing a predetermined degree of compression for heating intake air to facilitate combustion of a fuel injected or otherwise inserted into the combustion chamber. The piston lengths are geometrically determined in accordance with the piston stroke length and the lengths of apertures (described below) formed in the cylinders through which flow exhaust gases and air for combustion. In addition, first and second piston caps (not shown) may be attached to faces of associated ones of pistons 120 and 130 (or to associated optional piston spacers 122 and 132 in an embodiment where spacers are used). In one embodiment, each piston cap 124 and 134 is formed from a sandwich of two sheets of carbon fiber with a ceramic center. The piston caps 124 and 134 which are exposed to the combustion event are slightly concave in form so that when the two piston caps 124 and 134 meet in the center of the cylinder they form a somewhat spherical combustion chamber. Only the ceramic cores of the piston caps 124 and 134 actually come into contact with the stationary cylinder wall.

Each piston should have a length from the piston fire ring to the cap suitable for keeping the piston rings out of the cylinder opening(s) 210*a*. The optional spacers 122 and 132, and piston caps 124 and 134 each have a diameter roughly equal to the interior of the associated cylinder, and may be made of carbon fiber, ceramic, or any other suitable material to aid in minimizing thermal inefficiencies during engine operation.

In an embodiment utilizing a delivery conductor and ground conductor for spark generation (as described in U.S. Pat. No. 7,448,352), the face of each piston (or the face of any spacer attached to the piston) may include a slot or groove (not shown) formed therein and configured for providing a clearance between the piston face and the delivery and ground conductors, as the pistons approach each other within the cylinder.

Crankshafts 140 and 142 are coupled to an associated gear train, generally designated 112. Gear train 112 converts rotational motion of the crankshafts to rotational motion of bevel gears 220, 222 rotationally mounted to the exterior of cylinder 210.

Gears 220, 222 mesh with complementary gears 250, 252 of gear train 112. Shafts 140 and 142 are connected to gears 112*b* and 112*a*, respectively, of gear train 112. Rotation of the gears 112*a* and 112*c* arranged between crankshaft 142 and gear 252 results in rotation of shaft 199 and gear 252 mounted thereon. Gear 252 rotates bevel gear 222 mounted on cylinder 210. Similarly, rotation of the gears 112*b* and 112*d* arranged between crankshaft 140 and gear 250 results in rotation of shaft 198 and gear 250 mounted thereon. Gear 250 rotates bevel gear 220 mounted on cylinder 210.

In one embodiment, the gear train 112 and bevel gears 250, 252 are configured to rotate the associated bevel gears 220 and 222 at a speed of one half crankshaft speed. In this embodiment, bevel gears 250 and 252 provide the gear reduction necessary to reduce the rotational speed of cylinder-mounted bevel gears 220 and 222. Thus, the bevel gears 220 and 222 will turn through one complete rotation for every two rotations of the crankshaft. During one rotation of the bevel gears 220 and 222, and in the manner described below, one complete combustion cycle (intake, compression, power, and exhaust) is completed within the cylinder.

Figure 36:
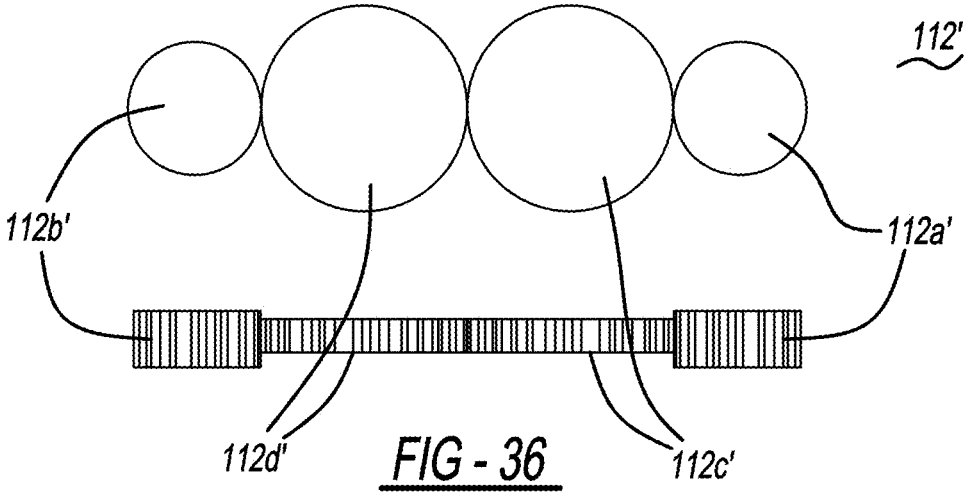
FIG. 36 shows a side view and an associated plan view of a gear train (112') in accordance with one embodiment described herein.

FIG. 36 shows a side view and a plan view of an alternative gear train 112'. Referring to FIG. 36, in this particular embodiment, gears 112*a*', 112*b*' connected to crankshafts 142, 140 (not shown) respectively, rotate at crankshaft speed but are reduced in size to serve as reducing gears. These gears perform the reducing function performed by bevel gears 250, 252 in the previously-described embodiment. Thus, the rotational speeds of the gears 112*c*' and 112*d*' (and the rotational speeds of the shafts 198 and 199 to which they are connected) are reduced to one half crankshaft speed, and the need for bevel gears 250, 252 as reduction gears is obviated. However, the desired rotational speed reduction may be implemented at any suitable point along the gear train connecting the crankshaft with the cylinder.

Various elements of the vehicle and/or engine systems (for example, an oil pump or coolant circulation pump) may be operatively coupled to and powered by the gear train 112, via the gears in the gear train itself or via shafts and additional gears operatively coupled to the gear train.

Referring to FIGS. 37-41, camming elements or cams, generally designated 400, are incorporated into the engine to actuate associated valve assemblies 30, 32, 34 (described below) which open and close to permit a flow of air to (and exhaust gases from) the cylinder combustion chamber during operation of the engine. The camming elements are mounted so as to be rotatable, and the elements are positioned so as to engage actuatable portions of the valve assemblies 30, 32, 34 during cam rotation.

In one embodiment, the camming elements 400 are coupled to (or positioned adjacent to) bevel gears 220 and 222 so as to rotate in conjunction with the gears. Gears 220 and 222 are rotatably mounted on exteriors of cylinder 210, as previously described, and are rotated by bevel gears 250, 252.

In alternative embodiments, the camming elements may be mounted in a location other than along the cylinder 210. In addition, rotation of the camming elements 400 may be effected by gears other than bevel gears 250, 252 or by methods other than coupling to a gear train.

Referring to FIGS. 37-41, in one embodiment, each of camming elements 400 includes one or more base portions 402 and one or more projecting portions 404 positioned adjacent an associated base portion. Each base portion 402 defines a cam profile or surface 402*a* engageable with an actuatable portion of an associated valve assembly to produce a first state of the valve assembly. Each projecting portion 404 defines a cam profile or surface 404*a* engageable with the actuatable portion of the valve assembly to produce an associated alternative state of the valve assembly.

The base and projecting portions of the cam are positioned and secured with respect to each other so as to form a continuous camming surface or profile 406 engageable by an associated actuatable valve element (such as a follower arm 704 as described herein) as the cam rotates. Thus, the actuatable valve element will alternately engage the cam base portion(s) and any associated projecting portion(s) as the cam rotates.

In the embodiment shown in FIGS. 37-41, the cam surfaces are arranged so as to extend radially outwardly from an exterior surface 210*s* of cylinder 210. The cam profile varies in height or radial distance from a central longitudinal axis Z of the cylinder, along the outer surface of the cylinder. Also, the projecting portions 404 of the cam extend outwardly from the cylinder to a greater degree than the base portions 402 of the cam. Thus, a portion of an actuatable valve element engaging a base portion 402 of a cam will be forced radially outwardly when a cam projecting portion 404 rotates so as to engage the actuatable valve portion.

If desired, the size of the opening leading into (or from) the combustion chamber may be controlled by suitably dimensioning the radial distance of an associated portion of the cam profile from the cylinder exterior surface. The amount of time or proportion of the engine cycle during which the valve is either open or closed may also be controlled by appropriately specifying the arc length occupied by the base portions 402 and projecting portions 404 of the cam profile. Transition of the valve assembly from a first state to a second state may be provided by a ramp or slope 404*b* formed in part of the projecting portion 404.

FIGS. 37-41 show embodiments wherein the base portions 402 of the cam profiles reside at equal radial distances from the cylinder exterior surface, and wherein the projecting portions 404 of the cam profiles reside at equal radial distances from the cylinder exterior surface. As seen in FIGS. 37-41, the distances of the projecting portion profiles 404*a* from the cylinder surface 210*s* are greater than the distances of the base portion profiles 402*a* from the cylinder surface. Thus, this embodiment provides two states (for example, "valve open" and "valve closed"), each state corresponding to a distance of one of the base portion profile or the projecting portion profile from the cylinder exterior surface, between which an associated valve assembly alternates during rotation of the cam.

In other embodiments, any one of multiple intermediate states of the valve assembly may be achieved and maintained by providing cam projecting portions defining cam surfaces located at corresponding distances from the cylinder exterior surface 201*a*. For example, in the embodiment shown in FIG. 38, a cam base portion surface 402*a* may be dimensioned to provide a closed state of the valve. In addition, a first projecting portion 404 having a camming surface 404*a* spaced a first radial distance D5 from the cylinder when mounted thereon may be attached to base portion or to the cylinder to provide a "partially open" state of the valve when engaged by an associated actuatable valve portion (not shown). Also, a camming surface 404*c* formed on projecting portion 404 (or on a separate projecting portion) and spaced a second radial distance D6 from the cylinder greater than the first distance D5 may be attached to base portion 402, to first projecting portion 404, or to the cylinder 210 to provide a "fully open" state of the valve when engaged by the actuatable valve portion. Surfaces 404*b* are ramped surfaces transitioning between the various states just described.

In a particular embodiment, when the actuatable portion of the valve assembly engages and slides along the base portion(s) 402 of the cam profile, the associated valve assembly is in a closed condition (i.e., the valve assembly prevents flow of air into (or exhaust gases from) the cylinder combustion chamber. Also, when the actuatable portion of the valve assembly engages and slides along the projecting portion(s) 404, the valve assembly is in an open or partially open condition (i.e., the valve assembly permits flow of air into (or exhaust gases from) the cylinder combustion chamber.

The camming elements may be in the form of rings or other structures attachable to the exterior surface of the cylinder 210, to gears 220 and 222, or to other suitable features of the engine. In a particular embodiment, the base and projecting portions of the camming elements are modular in construction so that these elements may be changed out to provide any of a variety of cam profiles. In addition, the projecting portions of a cam profile may be changed out independently of the base portions of the profile. These options enable greater flexibility in control of the valve sequencing, enabling correspondingly greater control of the engine cycle.

Base portion(s) 402 and projecting portion(s) 404 may be attached to cylinder 210 or to an associated one of bevel gears 220, 222 using any suitable method. In one embodiment, the base portion(s) 402 and projecting portion(s) 404 are attached to the bevel gear using screws or bolts, to enable the base portion(s) 402 and/or projecting portion(s) 404 to be changed over, or to enable their positions along the cylinder exterior to be adjusted.

In a particular embodiment, the method used to attach the projecting portion(s) 404 to the base portion(s) 402 or the associated bevel gear enables the position of one or more of the projecting portion(s) 404 along the cylinder exterior surface 210*s* (and relative to the position of the base portion(s)) to be adjusted. In this embodiment, the projecting portion(s) 404 may be unsecured from the associated base portion(s) 402 and slid along the surface 210*s* of the cylinder 210, bevel gear or base portion 402 or otherwise re-positioned with respect to the base portion 402. The re-located projecting portion(s) 404 may then be secured in the new position.

Because the projecting portion 404 actuating the valve can be relocated so as to engage the valve either sooner or later during rotation of the cam (and, therefore, sooner or later in the engine cycle), the associated valve may be opened or closed either sooner or later during the engine cycle. Thus, the detachability and modularity of the camming elements 402 and 404 enable fine tuning of the engine cycle by adjustment of the valve actuation timing.

Alternatively, one projecting portion may be swapped out for another projecting portion which actuates the valve at a different point in the engine cycle and/or for a different length of time.

Figure 40:
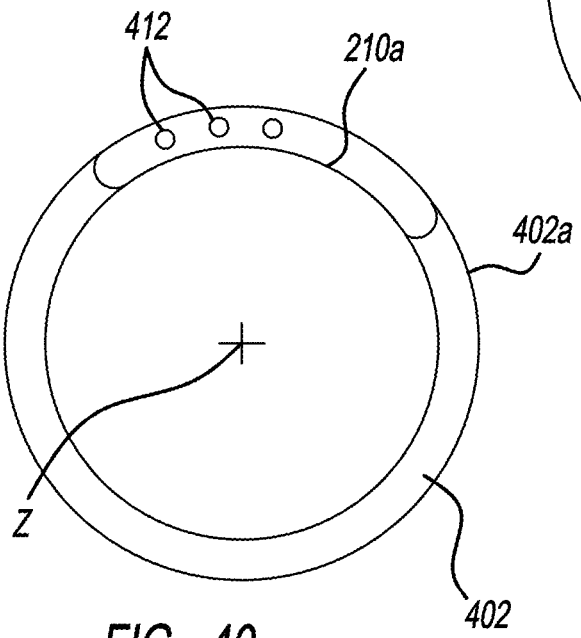
FIG. 40 is a side view of a camming element base portion in accordance with another embodiment of the present invention.
Figure 41:
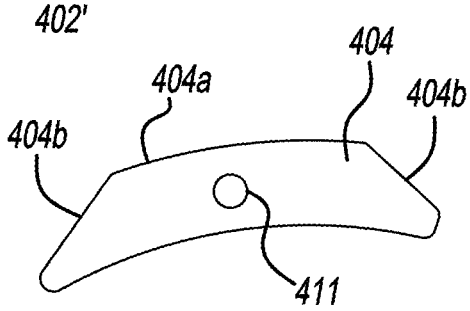
FIG. 41 is a side view of a camming element projecting portion in accordance with an embodiment of the present invention.

Referring to FIGS. 40 and 41, in one particular embodiment, a bolt 411 extends through cam projecting portion 404 and a series of holes 412 configured for receiving bolt 411 therein is formed in base portion 402 (or in an associated one of bevel gears 220, 222). The projecting portion 404 is secured to the base portion 402 (or to the bevel gear) by applying a fastener to bolt 411 after the projecting portion is has been positioned in a desired location. Alternatively, holes may be threaded for threadedly receiving bolt 411 therein. To change the position of the projecting portion 404 relative to the base portion 402 along the exterior surface 210*s* of the cylinder, the bolt is removed from the hole in which it resides and the projecting portion 404 is repositioned such that the bolt receiving hole on the projecting portion 404 is aligned with a hole 112 corresponding to the new desired position of the projecting portion 404. The bolt is then reinserted into and secured within the different hole 412.

Figure 39:
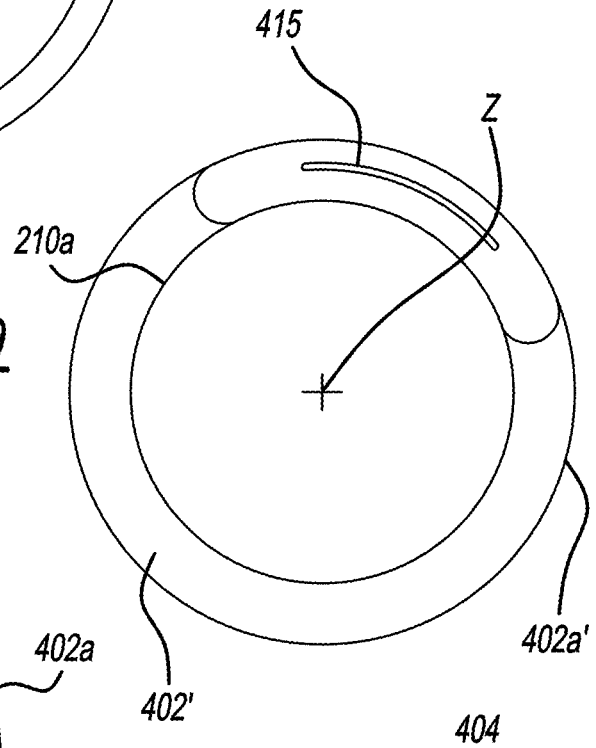
FIG. 39 is a side view of camming element base portion in accordance with an embodiment of the present invention.

Referring to FIGS. 39 and 41, in another particular embodiment, a bolt 411 extends through cam projecting portion 404 and a slot 415 configured for receiving bolt 411 therein is formed in base portion 402 (or in an associated bevel gear). The projecting portion 404 is again secured to the base portion 402 (or to the bevel gear) by applying a fastener to bolt 411 after the projecting portion is has been positioned in a desired location. To change the position of the projecting portion, the fastener is detached or loosened and projecting portion 404 positioned at a desired location with bolt 411 sliding along slot 415, whereupon the fastener is reapplied to bolt 411 to secure the projecting portion 404 in the desired new location. The use of a continuous slot 415 enables selection of any of a wide range of very closely spaced final positions for the projecting portion 404, permitting a relatively greater degree of control over the engine cycle than a mounting structure including discrete holes as previously described.

Figure 42:
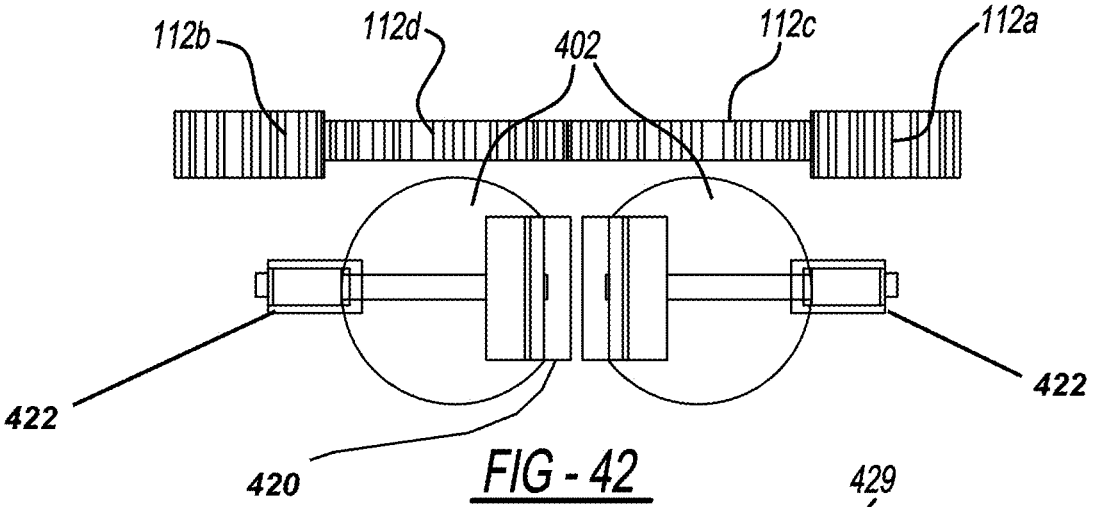
FIG. 42 is a schematic view of one embodiment of cam discs rotatably mountable on respective shafts or mounts drivable by a gear train.
Figure 43:
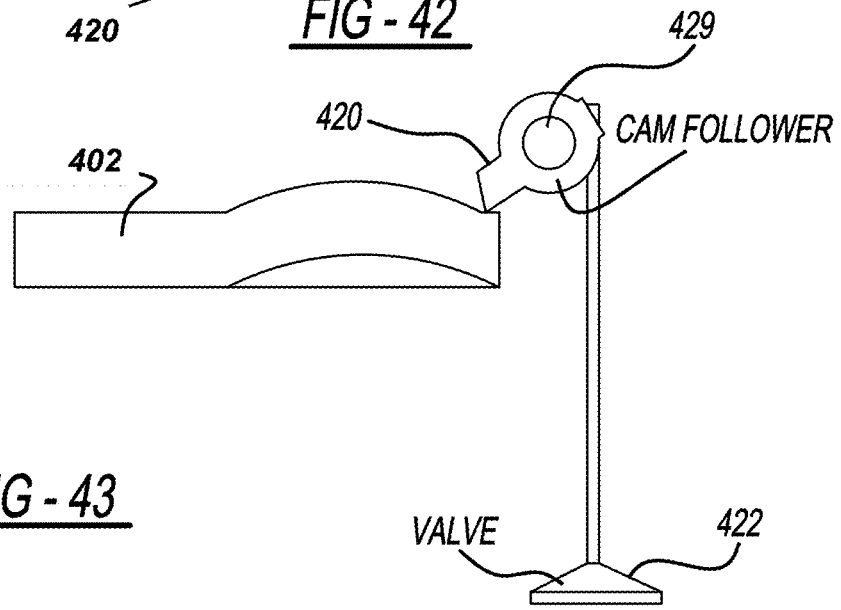
FIG. 43 is a schematic view of an embodiment showing cam profiles formed into outer edges of cam discs as shown in FIG. 42.
Figure 37:
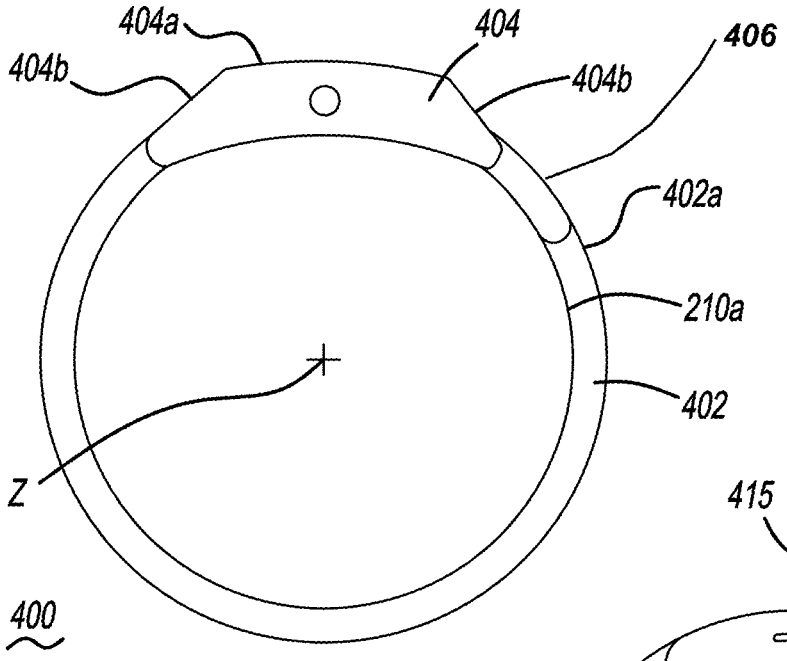
FIG. 37 is a side view of one embodiment of a camming element incorporated into an embodiment of the engine to actuate an associated valve assembly.

The cam profiles may be formed into the outer edges of the discs as shown in FIGS. 42 and 43. Referring to FIGS. 42 and 43, in another embodiment, the desired cam profiles are incorporated into discs 402 which are rotatably mountable on respective shafts or mounts (not shown) and which may be driven (through suitable gearing incorporated into the discs) by gears 112*c*, 112*d* of gear train 112 or by other gears, if desired. In this configuration, the rotational axes of discs 402 extend in directions perpendicular to directions of the rotational axes of gears 112*c*, 112*d*. A follower 420 connected to an associated valve 422 engages and follows the camming surfaces of the disc 402 as the disc rotates. When the follower 420 reaches and engages a camming surface residing out of the plane of the disc (as shown in FIG. 43), the follower is raised as described elsewhere herein, causing the follower or a pushrod coupled to the follower 420 to rotate a rocker arm 429, resulting in the opening of the valve 422 in a known manner. In this embodiment, one cam disc 402 may be positioned below the engine housing to actuate a valve mechanism positioned beneath the engine housing, while another cam disc 402 is positioned above the engine housing to actuate a valve mechanism positioned above the engine housing.

Figure 44:
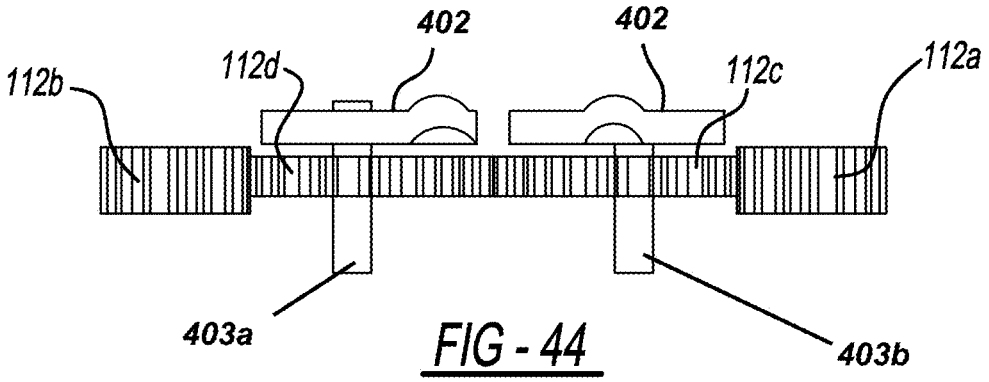
FIG. 44 is a schematic view of multiple cam discs as shown in FIG. 43, with each disc mounted coaxially with a set of gears so as to rotate in conjunction with the gears

Referring to FIG. 44, in another embodiment, a cam disc 402 as previously described is mounted coaxially with each of gears 112*d*, 112*c* along associated shafts 403*a* and 403*b* so as to rotate in conjunction with the gears. In addition, the follower (not shown) and/or other portions of the valve mechanism are oriented with respect to the cylinder housing 22 such that the valve coupled to the follower opens and closes as the follower engages and follows the camming surfaces, as previously described.

Figure 45A:
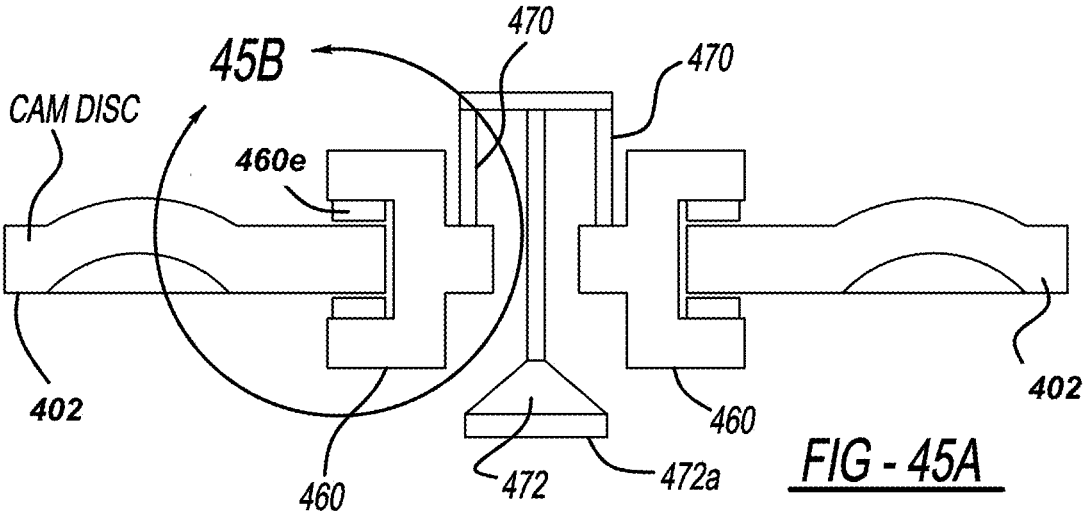
FIG. 45A shows a schematic view of an embodiment of a cam follower incorporated into (or operatively coupled to) a valve mechanism in accordance with an embodiment described herein.
Figure 45B:
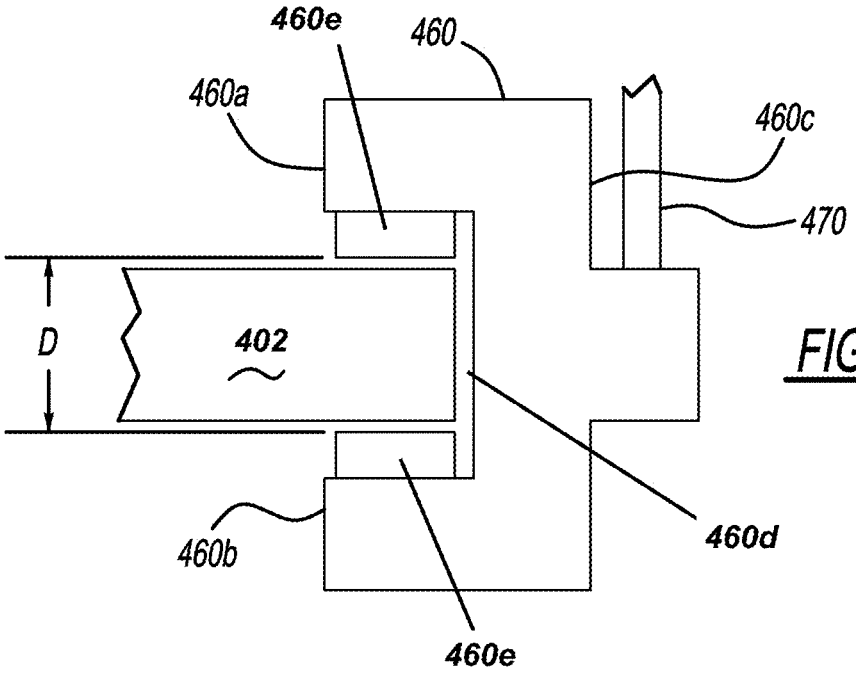
FIG. 45B is a detailed view of a portion of the embodiment shown in FIG. 45A.
Figure 46:
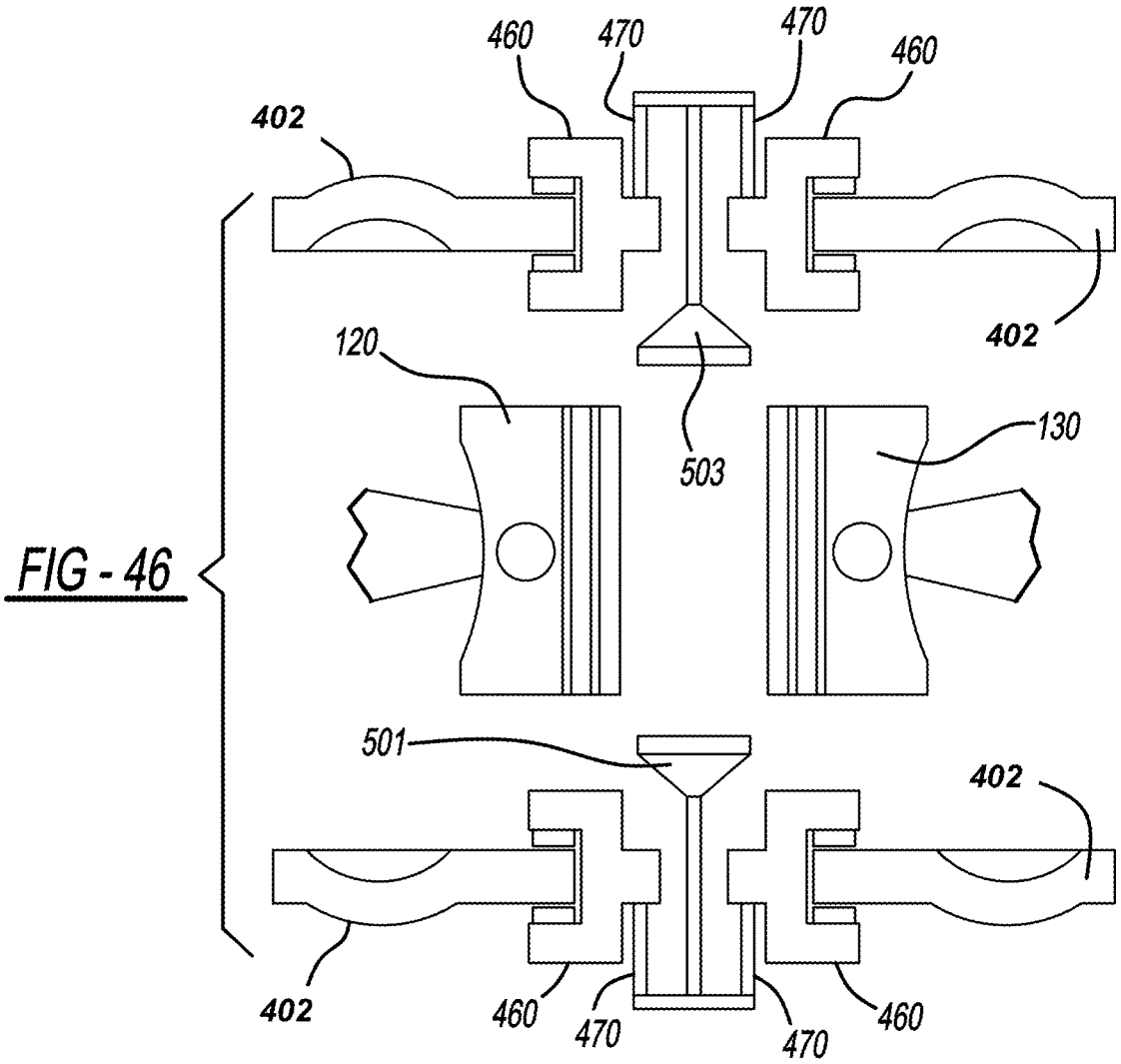
FIG. 46 shows a schematic view of an arrangement of one or more cam discs positioned below the engine to actuate an associated valve positioned beneath the engine, and one or more additional cam discs positioned above the engine to actuate an associated valve positioned above the engine.

FIGS. 45A, 45B and 46 show schematic views of other possible embodiments of a cam follower 460 incorporated into (or operatively coupled to) the valve mechanism. Follower 460 is configured to engage and follow camming surfaces formed along outer edges of a cam disc 402 as shown in FIG. 43. Follower 460 is also coupled to a pushrod 470 or other valve actuation element configured to actuate a valve stem 472 including a plug 472*a*, as previously described. Follower 460 includes a pair of walls 460*a* and 460*b* extending from a base portion 460*c* to define a cavity or groove 460*d* therebetween for receiving the outer edge of the cam disc 402 therein. Each of walls 460*a* and 460*b* includes a roller 460*e* (or other low-friction surface) mounted thereon to reduce contact friction between the follower 460 and the cam disc 402 as the edge of the cam disc rotates through the cavity 460*d*. The spacing D between the rollers 460*e* when not engaged with the cam disc 402 is slightly larger than the thickness t of the cam disc, thereby providing a slight clearance between the cam disc and the rollers. Because the cam disc edge travels within the cavity between rollers 460*e*, the follower configuration shown aids in ensuring positive engagement between the cam disc and the follower and relatively rapid response of the follower to changes in the cam profile. This enables more control over valve actuation timing. As shown in FIG. 46, one or more cam discs 402 may be positioned below the engine housing to actuate a valve 501 positioned beneath the engine housing, while one or more additional cam discs 402 are positioned above the engine housing to actuate a valve 503 positioned above the engine housing.

Figure 47:
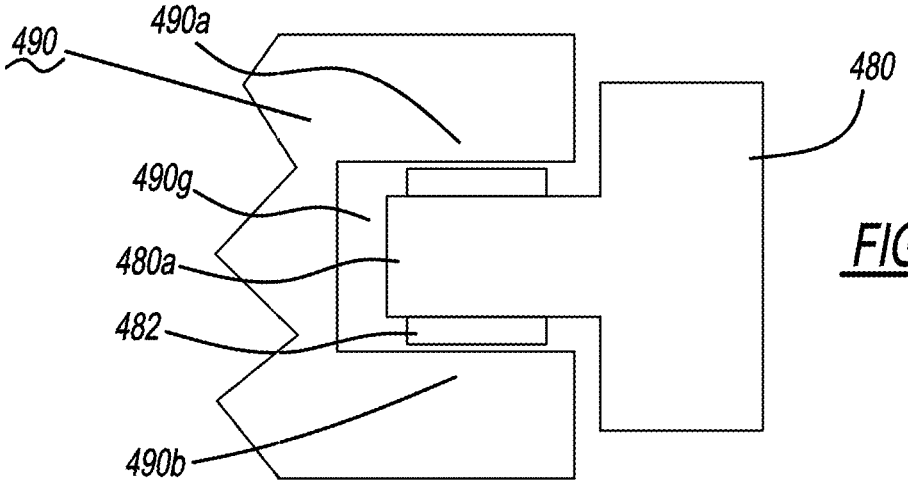
FIG. 47 shows a schematic view of an embodiment wherein a cam follower incorporating an extension and at least one roller mounted in the extension and operatively coupled to a valve mechanism.

FIG. 47 shows another embodiment wherein a cam follower 480 operatively coupled to the valve mechanism incorporates an extension 480*a* and at least one roller 482 mounted in the extension. The extension 480*a* and roller 482 ride within a cavity or groove 490*g* formed in an edge portion of the cam disc 490. The cavity 490*g* extends along the outer edge of the cam disc and has interior walls 490*a* and 490*b* configured to define the desired camming surfaces. The follower 480 is operatively coupled to a valve 501, as previously described. As the cam disc 490 rotates, the extension 480*a* rolls along and follows the cavity walls 490*a* and 490*b*. This motion opens and closes the valve 501 in correspondence with the configuration of the camming surfaces formed along the cavity interior, in the manner previously described.

In one embodiment (shown in FIGS. 1-6), conventional throttle valves 38, 40 are used to regulate the amount of airflow into the intake ports 300*b* of the cylinder housing, while modular poppet valve mechanisms 30, 32, 34 (as described below) are used to block and unblock the intake and exhaust ports at appropriate points in the engine cycle. Other types of valves are also contemplated.

FIGS. 1-6 and 12-30 show one embodiment of a valve arrangement usable for regulating air flow to (or exhaust flow from) the combustion chamber of an internal combustion engine. In the particular embodiments shown, the valve arrangement is incorporated into each of multiple modular valve assemblies (generally designated 30, 32, and 34). Each of valve assemblies 30, 32, 34 is configured to be mountable in any location (on a cylinder head or engine block of the engine, for example) where it can regulate air flow into (or exhaust flow from) an associated combustion chamber of the engine. The embodiment of the engine shown in FIGS. 1-6 and 12-30 incorporates three modular valve assemblies, 30, 32, 34. In the particular embodiment shown in FIGS. 1-6 and 12-30, modular valve assemblies 30, 32, 34 are mounted on cylinder housing 300 to control airflow into (and flow of exhaust gases from) cylinder 210 as previously described.

In the embodiments shown in FIGS. 1-6 and 12-30, the valve assemblies used to regulate air flow to the cylinder combustion chamber or exhaust flow from the chamber are in the form of conventional spring-loaded poppet valve mechanisms. Each of modular valve assemblies 30, 32, 34 is a self-contained conventional spring-loaded poppet valve mechanism which is independently attachable to cylinder housing 300 (or to another suitable portion of the engine, such as a cylinder head or engine block of the engine, for example). However, other types of valves may be used and elements thereof may be mounted on a base as described herein to provide a modular valve assembly.

In the embodiments shown in FIGS. 12-30, each valve assembly includes a base 799 to which all the actuatable and movable elements of the poppet valve mechanism are operably coupled. Base 799 may be formed from aluminum, steel, or any other suitable material using any suitable process or processes, such as casting, molding, drilling, and machining, for example.

A conventional valve stem 708 having a plug 710 mounted to a first end 708*a* thereof is slidingly mounted in a first longitudinal cavity 798 formed in the base 799. A second end 708*b* of valve stem 708 extends from base cavity 798 so as to be engageable by a first end 706*a* of a rocker arm 706 which is rotatably coupled to base 799 at a pivotable connection 797. In the embodiments shown in FIGS. 12-30, the pivotable connection is in the form of a ball joint. However, a hinged connection (for example, a pin) may also be used.

A follower arm 704 is slidingly mounted in a second longitudinal cavity 796 formed in base 799. A second end 706*b* of the rocker arm 706 (on a side of pivotable connection 797 opposite the side which engages the valve stem) engages a first end 704*a* of the follower arm 704 so as to cause rocker arm 706 to rotate about the pivotable connection 797 responsive to motion of the follower arm 704 within the second cavity 796. A roller element 795 is mounted on an extension 704*c* projecting from a second end 704*b* of the follower arm 704 so as to be rotatable with respect to the extension. The roller element 795 is positioned to ride along a camming surface of a rotating camming element, as previously described. Alternatively, a low-friction coating or other material may be applied to extension 704*c* to reduce friction between the extension and the cam surfaces.

Figure 48:
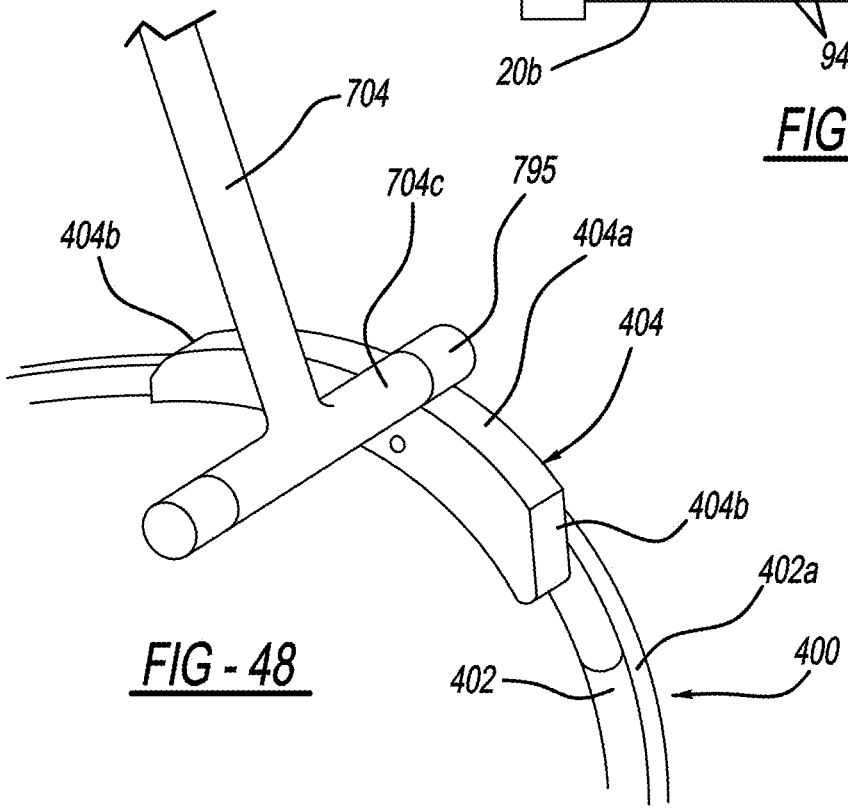
FIG. 48 shows a partial perspective view of a follower arm and attached roller element engaging a portion of a camming element having the structure shown in FIG. 37.

The mechanism by which a camming surface engages a follower arm to actuate a rocker arm so as to open and close an associated poppet valve is known in the art, and the similar operation of the particular valve embodiments shown in FIGS. 1-6 and 12-30 to control flow into and out of the cylinder combustion chamber are described herein. As described previously, the cam profile defined by each camming element 400 is configured to actuate the elements of the valve in accordance with an associated portion of the engine cycle. FIG. 48 shows a partial perspective view of a follower arm 704 and attached roller element 795 engaging a portion of a camming element 400 having the structure shown in FIG. 37.

In the embodiment shown in FIGS. 12-30, the roller element 795 is positioned so as to engage a camming element 400 rotatably mounted on cylinder 210. In the embodiment shown in FIGS. 12-30, a follower arm extension 704*c* extends from each of two opposite sides of a second end 704*b* of the follower arm, and roller element 795 is mounted along each of follower arm extensions 704*c*. In another embodiment (not shown), a follower arm extension 704*c* extends from a single side of the end 704*b* of the follower arm, and a roller element 795 is mounted along the single follower arm extension.

In addition, follower arm 704 is slidable along its longitudinal axis 704*d* within its base cavity 796 responsive to motion of the attached roller element(s) 795 due to engagement between the roller element(s) and the camming surfaces of camming element 400. That is, the follower arm 704 slides along its longitudinal axis 704*d* within cavity 796 as the attached roller element(s) 795 track the rotating camming-surfaces and move responsive to contact with the camming surfaces.

Each base 799 also has an interior port 793 adjacent the combustion chamber of the cylinder, an exterior port 792, and an internal passage 791 extending through the body of the base to connect the interior and exterior ports. Interior port 793 is positioned proximate or in direct fluid communication with a fuel combustion chamber of the engine such that gases exiting the base 799 into the combustion chamber flow through the interior port, and such that gases exiting the combustion chamber and entering the base 799 flow into the base through the interior port. Exterior port 792 is in fluid communication with the combustion chamber via interior port 793 and passage 791. Gases exiting the base 799 to an exterior of the engine flow from the combustion chamber through the interior port, through the passage 791, then through the exterior port 792. Similarly, gases entering the base 799 to flow toward the combustion chamber flow into the base through the exterior port 792, then into the passage 791, then into the combustion chamber via the interior port. In an embodiment in which the valve assembly is used as an air intake valve, a conventional throttle valve may be mounted on base 799 to cover exterior port 792. This enables the flow of air into the valve to be regulated, as known in the art. In the embodiments shown, throttle valve 40 regulates intake airflow to exterior port 792 of poppet valve mechanism 32, and throttle valve 38 regulates intake airflow to exterior port 792 of poppet valve mechanism 30.

In the particular embodiment shown in FIGS. 12-30, interior port 793 is positioned in direct fluid communication with an interior of a cylinder 210 of an opposed piston engine which defines the fuel combustion chamber. Base 799 may also have holes (not shown) or other features which facilitate attachment of the base to an engine block, cylinder head, vehicle frame or other portion of the vehicle.

In the particular embodiment shown in FIGS. 12-30, to mount the modular valve assembly 30 on the cylinder head, engine block, or on cylinder housing 300 as shown, an annular wall 799*d* extends from an exterior surface of the base 799 and circumscribes the interior port opening 793. Wall 799*d* is sized so as to form an interference fit with an opening formed in the cylinder head, engine block, or with opening 300*b* or 300*d* in cylinder housing 300, which leads into the cylinder interior or combustion chamber. Wall 799*d* is inserted into opening 300*b* or 300*d* to provide an interference fit between the wall 799*d* and the edge of the opening, thereby securing the base 799 to the cylinder head, engine block, or cylinder housing and forming a gastight seal between the base and the cylinder head, engine block, or cylinder housing. This arrangement also provides a path for combustion airflow into (or exhaust gases from) the cylinder via the passage 791 connecting the base interior port 793 with the base exterior port 792. If desired, features may be incorporated into base 799 for additional fastening means (for example, bolts or other mechanical fasteners) to aid in attaching the base to the engine block, cylinder head, or other desired portion of the vehicle.

In the particular embodiment shown in FIGS. 12-30, each of modular valve assemblies 30, 32, 34 is configured to be mountable on a cylinder housing in accordance with an embodiment of the present invention. Each of modular valve assemblies 30, 32, 34 is mounted in an associated cylinder housing opening 300*b* or 300*d* overlying an associated opening formed in the cylinder.

Each modular valve assembly may also include a valve adjustment mechanism permitting the position of the pivotable connection 797 to be varied with respect to the valve assembly base 799. In the particular embodiment shown in FIGS. 12-30, pivoting of the rocker arm 706 is enabled by mounting the rocker arm on a ball joint. A through hole is provided in the ball joint 797, and a bolt 797*a* threadedly and adjustably connects the ball joint 797 and rocker arm 706 to valve assembly base 799.

Prior to attachment of the base 799 to the to the cylinder head or engine block, bolt 797*a* may be rotated in a first direction to provide a relatively larger space between the ball joint 797 and the base 799. After the base 799 has been attached to the cylinder head or engine block, the bolt 797*a* may be rotated in a second direction opposite the first direction to decrease the distance between the ball joint 797 and the base 799 until the roller element(s) mounted on the second end 704*b* of follower arm 704 is in a position to engage the camming surfaces in a desired manner during operation of the engine. A high temperature tape (not shown) or other suitable mechanism may be applied to the threaded portion of bolt 797*a* to impede free rotation of the bolt, to aid in retaining the bolt and ball joint in a desired position once it has been achieved. Other methods of enabling adjustment of the rocker arm position are also contemplated.

This ability to adjust the position of the rocker arm relative to the base 799 enables the initial position of the cam-engaging portion of follower arm 704 to be "fine tuned" after securement of the valve base 799 to the cylinder head or engine block. This helps ensure that subsequent axial displacement of the follower arm during operation of the engine results in proper opening and closing of the valve responsive to variations in the camming surface profile during rotation of the camming surfaces.

In an alternative embodiment, a mechanism is provided enabling the distance along the follower arm 704 between the rocker arm 706 and a rotational axis of the roller element 795 to be adjusted to some degree and secured in a desired position. This enables adjustment of the initial position of the cam-engaging portion of follower arm 704 as previously described.

Referring to FIGS. 12-30, a countersink or recess 799*h* may be formed in a surface of base 799 adjacent an opening 799*j* leading into base first longitudinal cavity 798. In addition, a boss 799*m* extends from a floor 799*p* of the recess 799*h* and surrounds the opening 799*j*. A hard stop (not shown) is secured to a portion of follower arm 704 spaced apart from base 799.

A spring member (not shown) is positioned between the recess floor 799*p* and a hard stop (not shown) and is compressed between the floor and the hard stop so that the spring member exerts a counterforce on each of these elements. In one embodiment, the spring member is a conventional coil spring member positioned in recess 799*h* between boss 799*m* and a wall of the recess. However, other types of springs may also be used. This spring member tends to bias the plug against a seat 789 formed along the interior port 793, thereby closing the interior port. As previously described, rocker arm 706 rotates about pivotable connection 797 responsive to movement of the follower arm 704 in cavity 796 responsive to engagement between roller element 795 and the associated camming surface.

Follower arm end 704*a* abuts rocker arm end 706*b* to actuate this end of the rocker arm, and stem end 708*b* abuts rocker arm end 706*a* to actuate the an opposite end of the rocker arm. The follower arm 704 and/or the rocker arm 706 and/or the valve stem 708 or the contact interfaces between the follower arm 704 and the rocker arm 706 and between the valve stem 708 and the rocker arm may be formed using materials directed to minimizing friction and/or wear at the contact interfaces. Also, suitable coatings, surface treatments, and or other friction and wear reduction means may be applied to the engaging surfaces, if desired.

Figure 12:
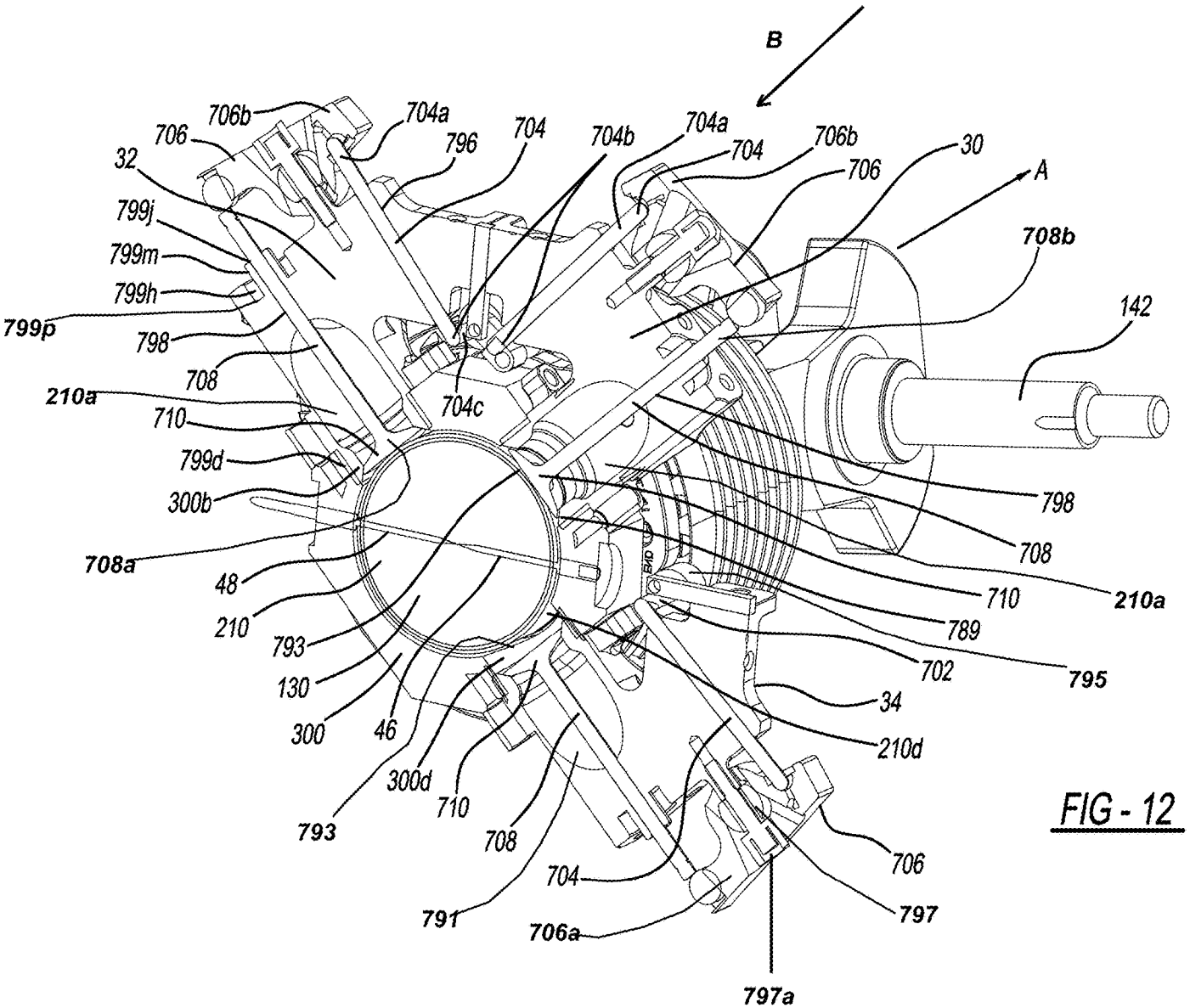
FIGS. 12-17 show a succession of cross-sectional perspective views taken through the cylinder housing and cylinder of an embodiment of the engine during progression of an intake phase of the engine cycle.
Figure 13:
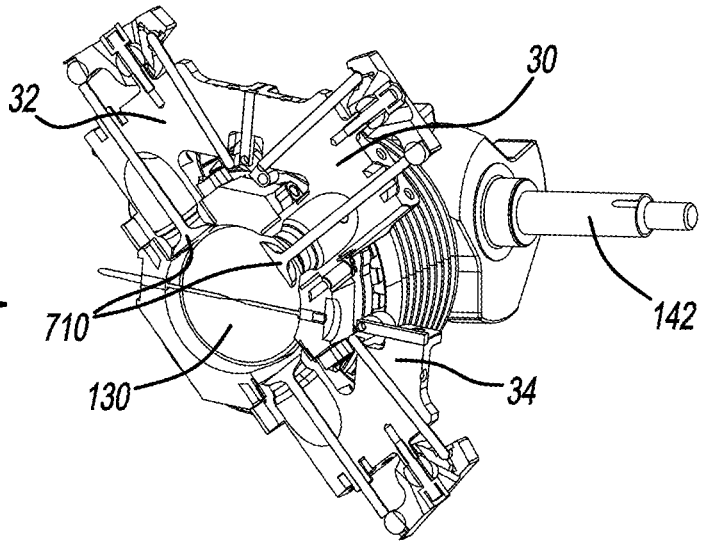
Figure 14:
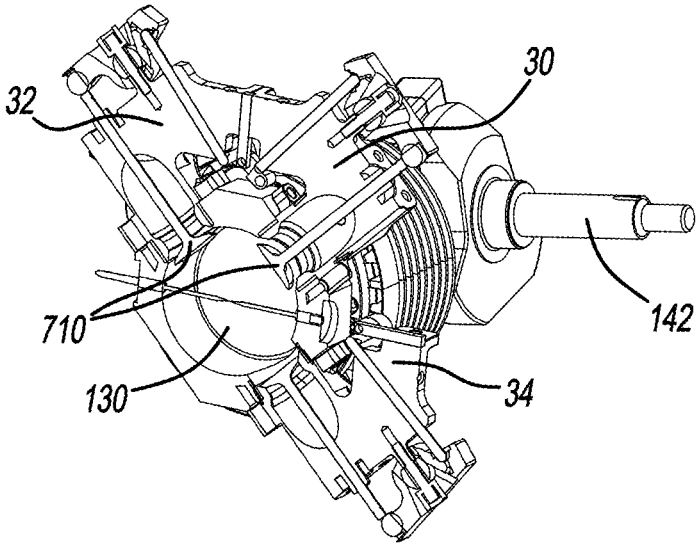
Figure 15:
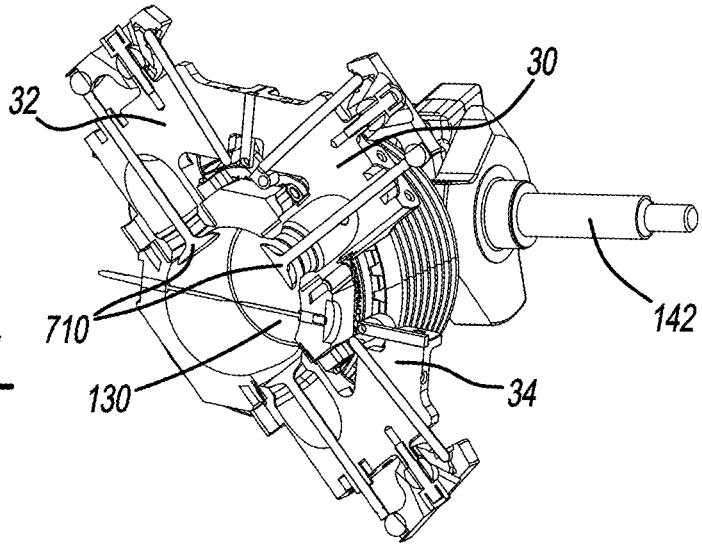
Figure 16:
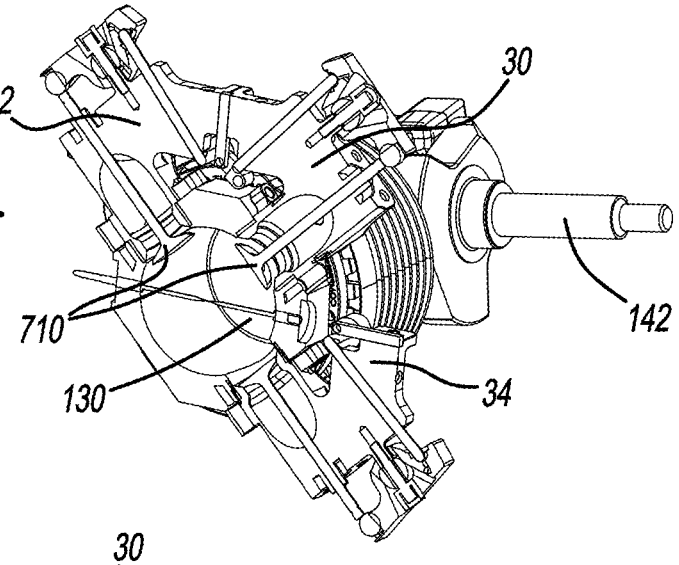

Referring to FIGS. 12-30, and 37-41, when the roller element 795 engages a radially outermost camming surface 404*a* of the camming element, follower arm 704 moves within base cavity 796 generally outwardly away from the cylinder, in the direction indicated by arrow "A" (for valve mechanism 30 in FIG. 12). In response, follower arm end 704*a* engages rocker arm end 706*b*, rotating the rocker arm about pivotable connection 797 and forcing stem 708 in the direction indicated by arrow "B" (generally inwardly toward the cylinder) to open the valve. This compresses the spring member between the hard stop and floor 799*p*. FIGS. 13-16 show the valve 30 in an open condition.

As the camming element 400 continues to rotate, a camming surface 402*a* located radially inwardly of the outermost camming surface 404*a* rotates into position opposite the roller element 795. This permits follower arm 704 to slide within cavity 796 in direction "B" so that the attached roller element 795 will engage the radially inward camming surface. This is accomplished by expansion of the spring member against floor 799*p* and the hard stop, forcing stem 708 to move in direction "A" until plug 710 rests against the interior port seat 789. Motion of stem 708 produces rotation of rocker arm 706 which forces follower to move in direction "B" within base cavity 796 until roller element engages the radially inward camming surface.

Since the spring member is always trying to force the valve closed, valve stem 708 is biased upward (in direction "A") against rocker arm 706. This tends to pivot the rocker arm and bias the rocker arm/follower arm interface downward (in direction "B") toward the camming surface. This biases roller element 795 against the camming surface and ensures that any variation in the camming surface will affect the valve plug position.

While the arrangement shown in FIGS. 12-30 represents a particular embodiment of the follower arm 704 and how the arm engages a camming surface, in alternative embodiments the follower arm may have any desired length and configuration required to enable a portion of the arm to engage a camming surface of a rotating cam element coupled to the engine.

The modularity of the above-described valve mechanism facilitates attachment of the valve to a cylinder head or engine block, and also facilitates repair, replacement, and adjustment of the valve or components thereof. Thus, a modular valve assembly in accordance with an embodiment described herein may be attached to the cylinder head or engine block of an engine, to obviate the need for the complex conventional arrangement of interconnected plugs, stems, rocker arms, and cam shafts used in many existing engines. The valve system can be configured such that a single vale or an entire group of independent valves is operable by a single shaft incorporating suitable camming surfaces. As each valve assembly may be installed and removed independent from other valve assemblies, repair and replacement of the valves is facilitated.

In embodiments of the engine incorporating multiple, adjacent cylinders, one or more shared intake plenums (not shown) and exhaust plenums (not shown) may be connected to the cylinder housings 60 (described below), the engine housing 20, and/or to another portion of a vehicle in which the engine is mounted. Air for combustion is drawn into the intake plenums and distributed to intake ports (not shown) formed in the intake plenums, in a manner known in the art. Similarly, exhaust gases from the combustion reactions in cylinders 210 are directed out of the cylinders through associated exhaust ports (not shown) and channeled from the exhaust ports to a shared exhaust opening (not shown) in the exhaust plenum, in a manner known in the art.

In another embodiment, one or more desmodromic valve mechanisms are employed. As defined herein, a "desmodromic valve" is a valve that is positively opened and closed by a camming mechanism, rather than by a conventional spring mechanism. The desmodromic valve embodiments described herein may include most of the elements incorporated into previously described embodiments. For example, the valve may include a base, an interior port, an exterior port, and an internal passage extending through the body of the base to connect the interior and exterior ports, as previously described. The valve may be mounted to the cylinder housing or engine housing in a manner previously described. In addition, an air intake valve may include a conventional throttle valve mounted on the base to cover exterior port, also as previously described. However, in particular embodiments, the valve is both opened and closed by sliding or rolling engagement between opposed, rotating camming surfaces, and a follower or actuating portion of the desmodromic valve mechanism residing between the opposed camming surfaces and operatively coupled to a valve plug. Thus, all actuation of the valve results from direct engagement between the camming surfaces and the stem extensions.

FIGS. 45A, 45B and 46 show another embodiment of a cam follower 460 incorporated into (or operatively coupled to) a desmodromic valve mechanism. Follower 460 is configured to engage and follow camming surfaces formed along outer edges of a cam disc 402 as shown in FIG. 43. Follower 460 is also coupled to a pushrod 470 or other valve actuation element configured to actuate a valve stem 472 including a plug 472*a*, as previously described. Follower 460 includes a pair of walls 460*a* and 460*b* extending from a base portion 460*c* to define a cavity or groove 460*d* therebetween for receiving the outer edge of the cam disc 402 therein. Each of walls 460*a* and 460*b* includes a roller 460*e* (or other low-friction surface) mounted thereon to reduce contact friction between the follower 460 and the cam disc 402 as the edge of the cam disc rotates through the cavity 460*d*. The spacing D between the rollers 460*e* when not engaged with the cam disc 402 is slightly larger than the thickness t of the cam disc, thereby providing a slight clearance between the cam disc and the rollers. Because the cam disc edge travels within the cavity between rollers 460*e*, the follower configuration shown aids in ensuring positive engagement between the cam disc and the follower and relatively rapid response of the follower to changes in the cam profile. This enables more control over valve actuation timing. As shown in FIG. 46, one or more cam discs 402 may be positioned below the engine to actuate a valve 501 positioned beneath the engine, while one or more additional cam discs 402 are positioned above the engine to actuate a valve 503 positioned above the engine.

FIG. 47 shows another embodiment wherein a cam follower 480 operatively coupled to a desmodromic valve mechanism incorporates an extension 480*a* and at least one roller 482 mounted in the extension. The extension 480*a* and roller 482 ride within a cavity or groove 490*g* formed in an edge portion of the cam disc 490. The cavity 490*g* extends along the outer edge of the cam disc and has interior walls 490*a* and 490*b* configured to define the desired camming surfaces. The follower 480 is operatively coupled to a valve 501, as previously described. As the cam disc 490 rotates, the extension 480*a* rolls along and follows the cavity walls 490*a* and 490*b*. This motion opens and closes the valve 501 in correspondence with the configuration of the camming surfaces formed along the cavity interior, in the manner previously described.

Figure 49:
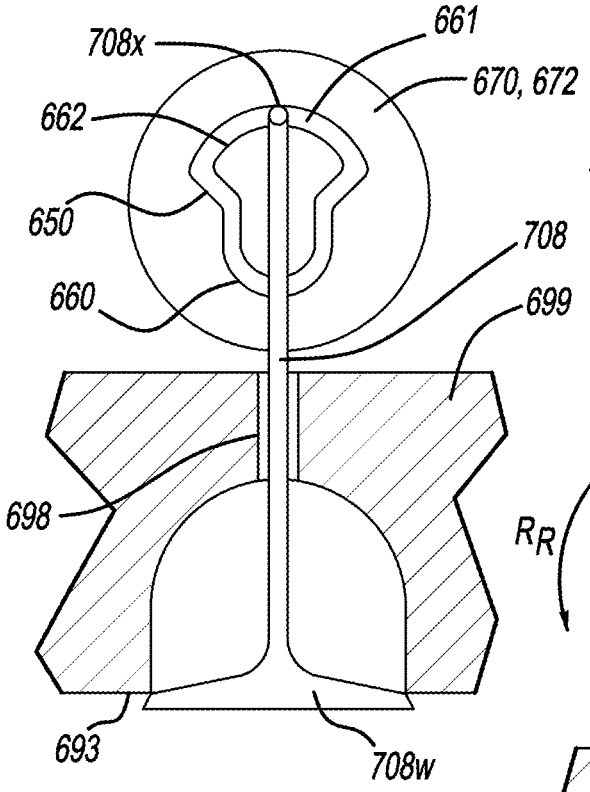
FIG. 49 is a partial cross-sectional view of a portion of a desmodromic valve portion in accordance with an embodiment of the present invention, showing the valve in a closed configuration.
Figure 50:
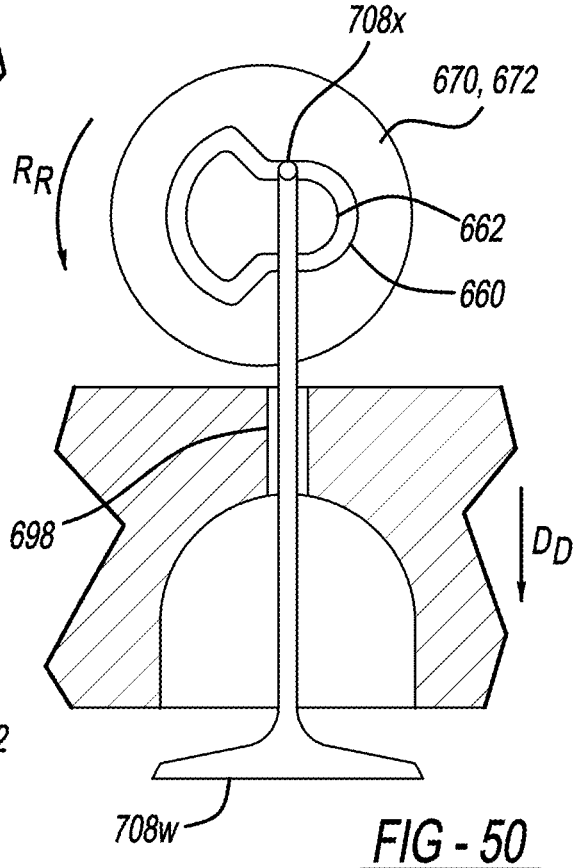
FIG. 50 is a partial cross-sectional view of a portion of the desmodromic valve portion of FIG. 49 showing the valve in an open configuration.
Figure 51:
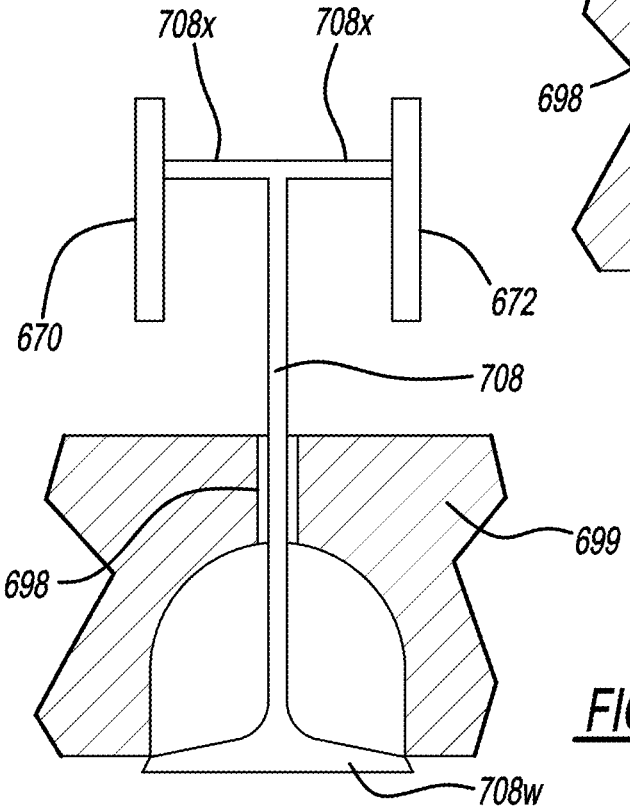
FIG. 51 is another partial cross-sectional view of a portion of the desmodromic valve portion shown in FIGS. 49 and 50.

Referring to FIGS. 49-51, in another embodiment of a desmodromic valve assembly, the assembly includes base 699, an interior port 693, an exterior port (not shown), and an internal passage (not shown) extending through the body of the base to connect the interior and exterior ports, as previously described. In an embodiment in which the valve assembly is used as an air intake valve, a conventional throttle valve (not shown) may be mounted on base 699 to cover the exterior port. This enables the flow of air into the valve to be regulated, as known in the art.

In the embodiment shown in FIGS. 49-51, valve stem extensions 708*x* project from opposed sides of the valve stem 708 to engage an associated pair of opposed rotating cams 670 and 672. Each of cams 670 and 672 has camming surfaces 660 and 662 formed into grooves 661 extending along surfaces of the cam residing between the cam axis of rotation and an outermost surface or perimeter of the cam, as described in U.S. patent application Ser. No. 12/645,287 and 61/180,108, in U.S. Published Application Nos. 2007/0095320 and 2009/0173299, and in U.S. Pat. No. 7,779,795, all incorporated herein by reference. Grooves 661 may have any configuration required to produce a desired motion of an associated valve stem coupled, according to the requirements of a particular engine cycle. The stem extensions 708*x* may have rollers, balls, or other features (not shown) mounted thereon to reduce friction and wear between the stem extensions and the camming surfaces, thereby facilitating relative movement between the stem extensions and the camming surfaces. The camming surfaces are configured as described in U.S. patent application Ser. No. 12/645,287 and 61/180,108, in U.S. Published Application Nos. 2007/0095320 and 2009/0173299, and in U.S. Pat. No. 7,779,795, all incorporated herein by reference, such that the stem extensions 708*x* slide or roll in the grooves 661 defined by the opposed camming surfaces 660, 662, so as to produce a motion of stems 708 along base passage 698 to open and close the valves at appropriate points in the engine cycle.

Cams 670, 672 are arranged so that the same portions of camming surfaces 660, 662 on each cam act on stem extensions 708*x* at the same time. That is, the camming surfaces on each cam are aligned with and form a mirror image of the camming surfaces on the other cam, so that cam 670 has the same effect on its associated stem extension 708*x* as cam 672 has on its associated stem extension, at the same time during rotation of the cams. Thus, the camming surfaces 660 and 662 act in unison to move the valve stem, alternating between a closed valve position (shown in FIG. 49) and an open valve position (shown in FIG. 50).

FIG. 49 shows a portion of camming surface 662 spaced a relatively greater distance from the center of rotation of the cam, engaging stem extension 708*x* to maintain the plug 708*w* in contact with the valve seat 693, thereby maintaining the valve in a closed condition. Arrow RR shows a direction of rotation of cams 670 and 672. FIG. 50 shows the cam in FIG. 49 rotated to an orientation where a portion of camming surface 660 spaced a relatively lesser distance from the center of rotation of the cam engages stem extension 708*x* to maintain the plug 708*w* in a position spaced apart from valve seat 693, wherein the valve is in an open condition. During rotation of the cams 670 and 672, stem extensions 708*x* travel along ramp portions 650 between the portions of the camming surfaces spaced at relatively greater and lesser distances from the cam axes of rotation.

It may be seen from FIG. 49 that engagement between camming surface 662 and an associated stem extension 708*x* produces a closed state of the valve, with plug 708*w* seated in seat 693. Also, engagement between camming surface 660 and an associated stem extension 708*x* will produces an open state of the valve, with plug 708*w* spaced apart from seat 693. Cams 670 and 672 may rotate on shafts (not shown) operatively coupled to gear train 112 (not shown in FIGS. 49-51) or to other gears or shafts. In addition, either or both of cams 670 and 672 may be formed as part of a gear (not shown) incorporated into the engine, or the cams may be formed as separate elements.

Details of the structure and operation of one embodiment of the engine and associated valve mechanisms are now described with reference to FIGS. 1-6 and 12-30.

Figure 17:
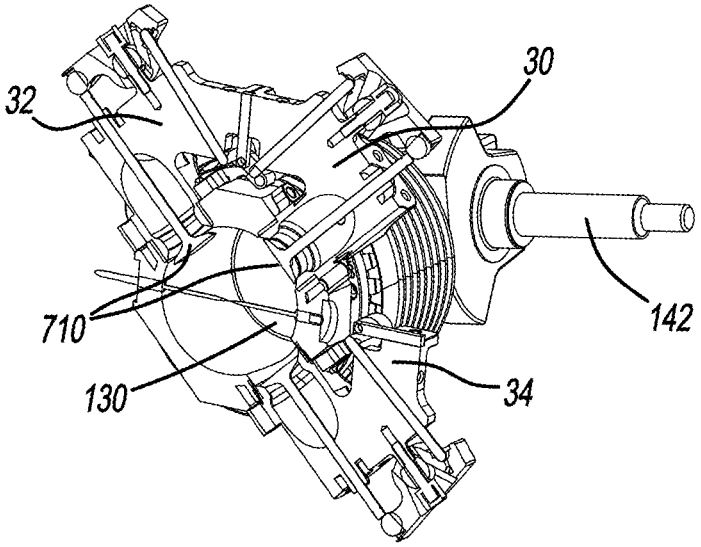
Figure 18:
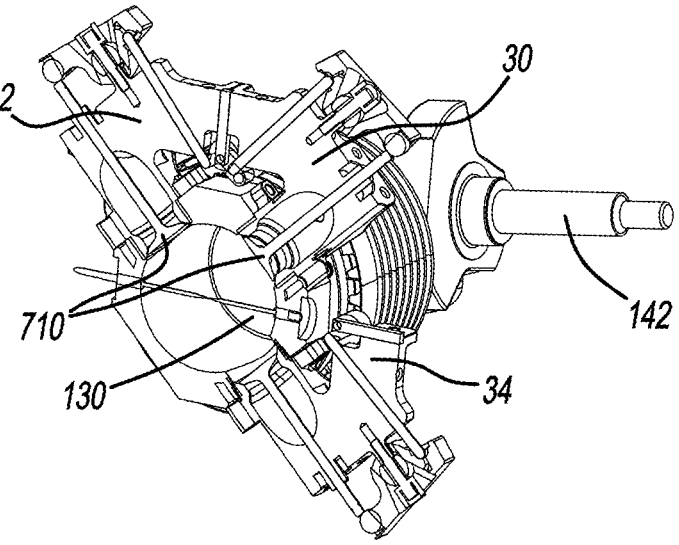
FIGS. 18-21 show a succession of cross-sectional perspective views taken through the cylinder housing and cylinder of an embodiment of the engine during progression of a compression phase of the engine cycle.
Figure 19:
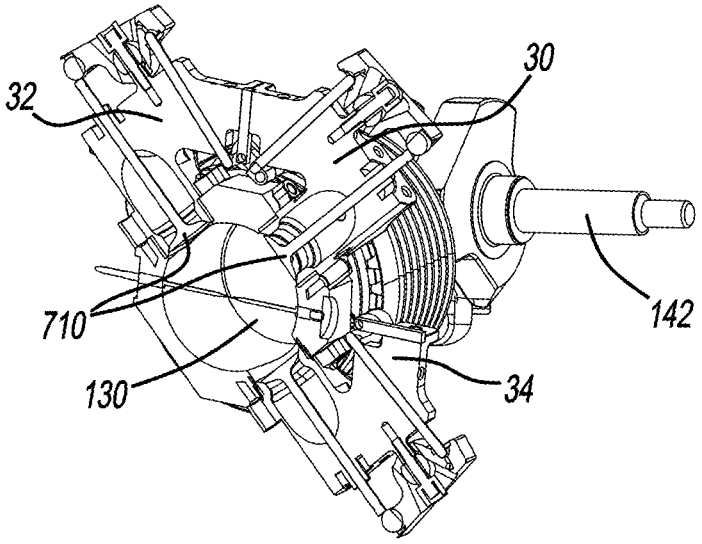
Figure 20:
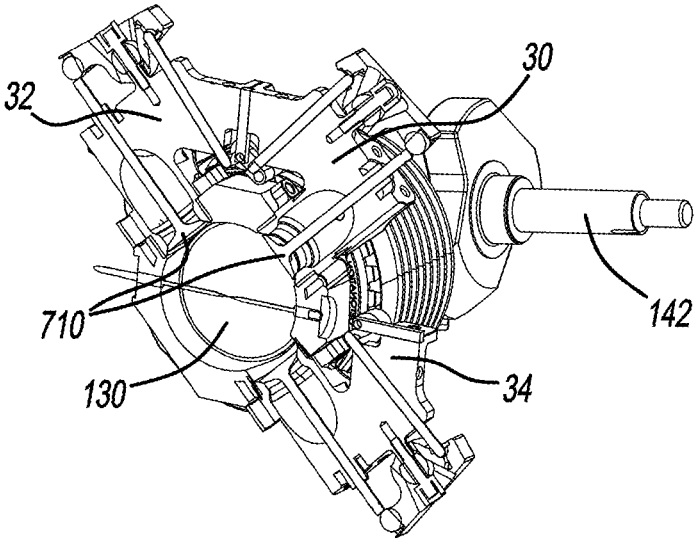

FIGS. 12-17 show a cross-sectional view taken through the cylinder housing and cylinder during the intake phase of the engine cycle, as the modular poppet valves 30, 32, 34 actuate and as piston 130 moves within cylinder 210. Referring to FIGS. 12-17, as camming elements 400 rotate on cylinder 210, the cam surfaces engage cam followers 704, causing valve portions 710 to gradually open as seen in FIGS. 12-17, while the pistons 120 (not shown) and 130 are drawn away from the center of the cylinder. This admits combustion air and/or air-fuel mixture into the cylinder interior via the poppet valves 30 and 32. As seen in FIG. 17, by the end of the intake cycle, valve portions or plugs 710 are blocking their respective intake ports to seal the combustion chamber. It may be seen from FIGS. 12-15 that plugs 710 of valve stems 708 on valve mechanisms 30 and 32 move toward the centerline of the cylinder interior responsive to rotation of the camming elements mounted on the cylinder and the engagement between the camming elements 400 and the follower arm extensions 704*c* on follower arms. This movement of the plugs 710 enables intake air to be drawn into the cylinder responsive to the outward movement of the pistons 120 and 130 toward respective ends of the cylinder.

Figure 21:
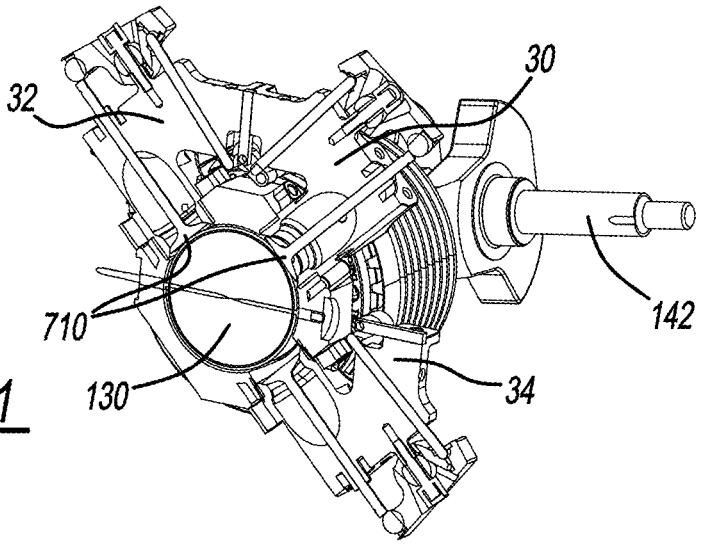
Figure 22:
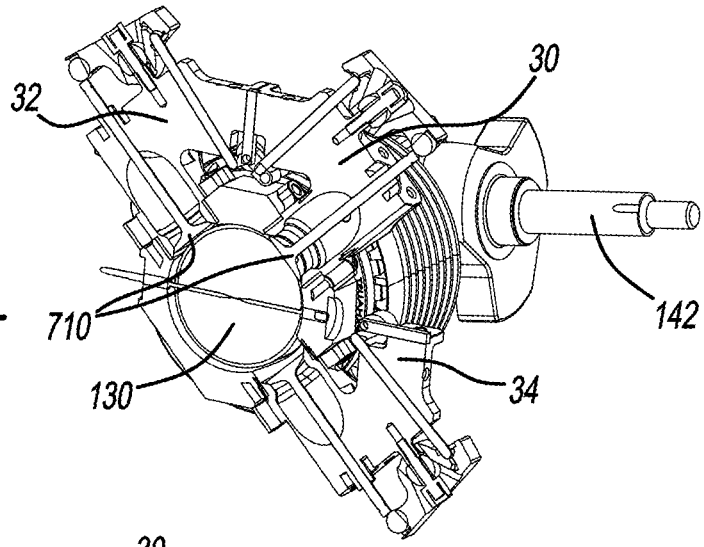
FIGS. 22-26 show a succession of cross-sectional perspective views taken through the cylinder housing and cylinder of an embodiment of the engine during progression of a power phase of the engine cycle.
Figure 23:
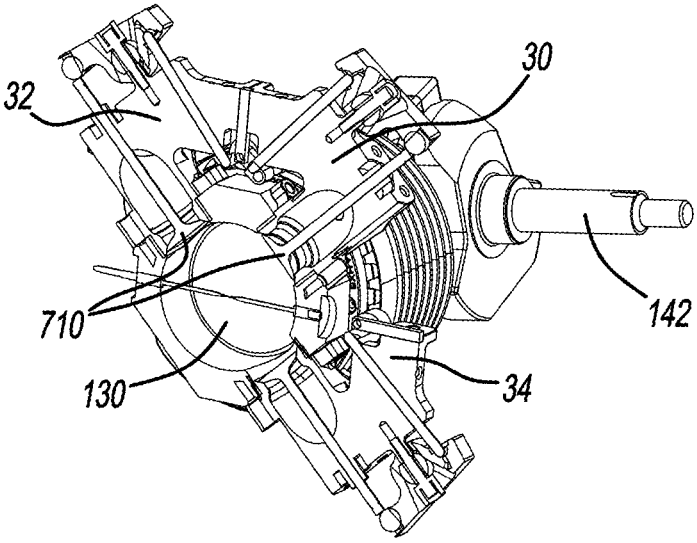
Figure 24:
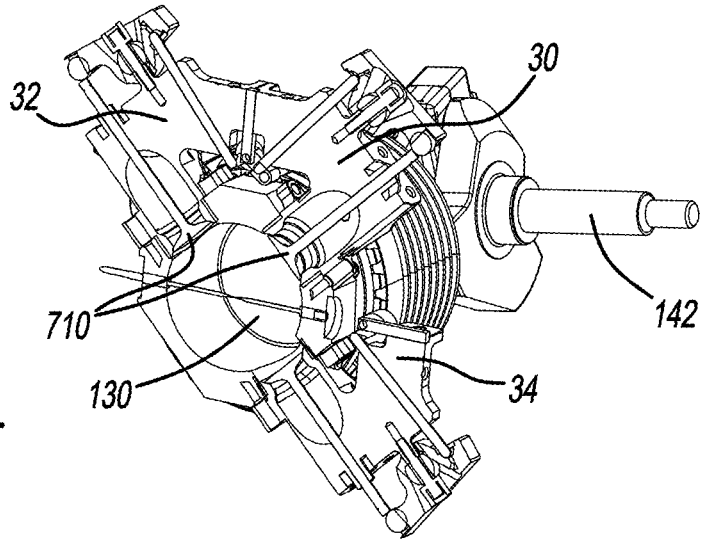
Figure 25:
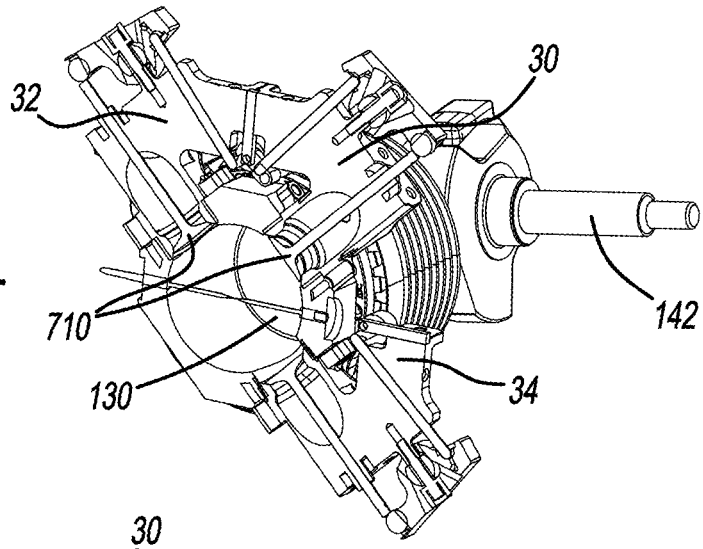
Figure 26:
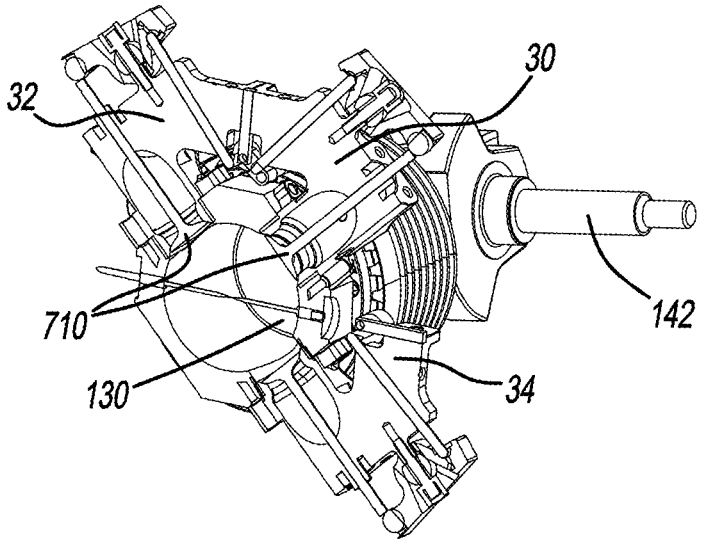
Figure 27:
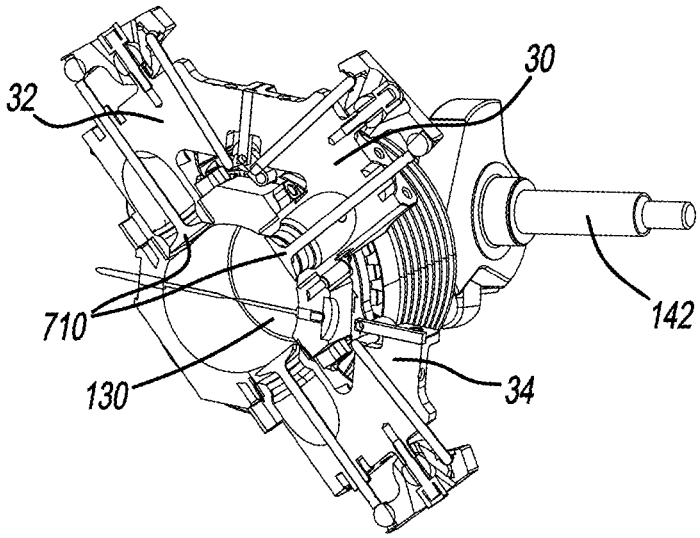
FIGS. 27-30 show a succession of cross-sectional perspective views taken through the cylinder housing and cylinder of an embodiment of the engine during progression of an exhaust phase of the engine cycle.
Figure 28:
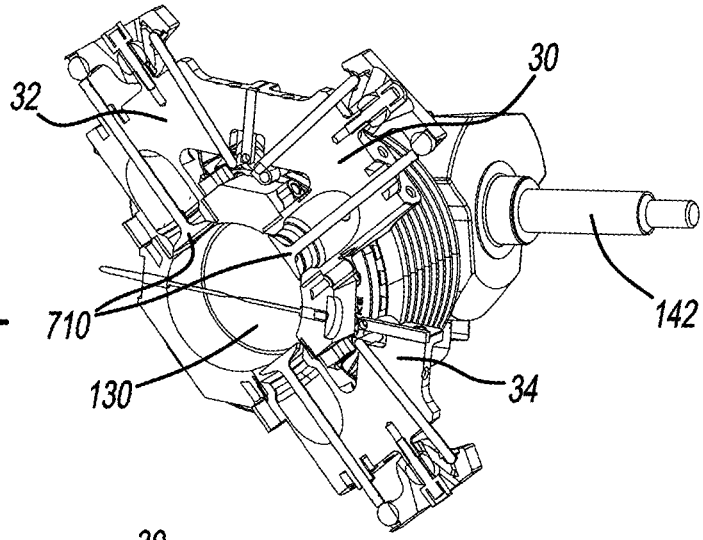
Figure 29:
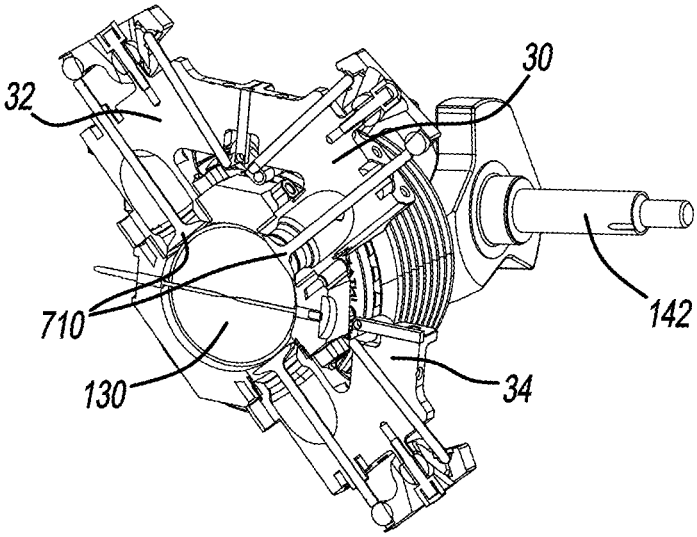
Figure 30:
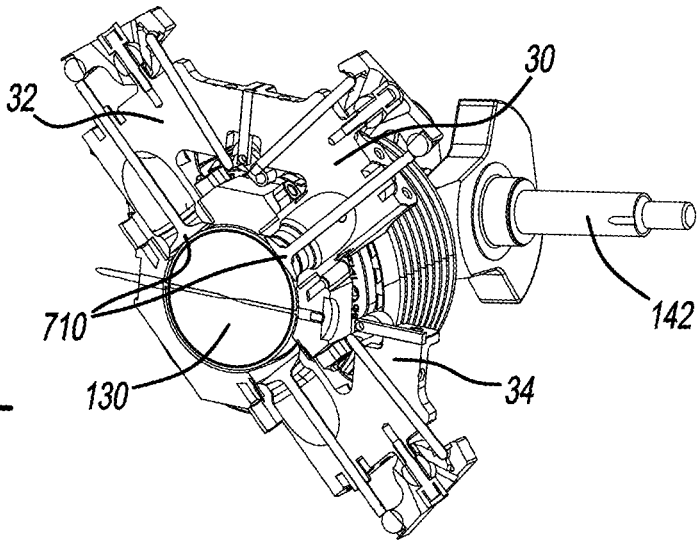

FIGS. 18-21 show cross-sectional views similar to those shown in FIGS. 12-17 taken through the cylinder housing and cylinder during the compression phase of the engine cycle. Referring to FIGS. 18-21, as camming elements 400 continue to rotate on cylinder 210, the pistons 120 and 130 approach the center of the cylinder with the valve portions 710 seated as shown, thereby compressing the air-fuel mixture within the combustion chamber. Referring to FIG. 21, at the end of the compression cycle, an ignition pulse or spark is initiated by an ignition source (in this case, comprising delivery conductor 44 and ground conductor 46), causing ignition of the air-fuel mixture and initiating the power phase of the cycle. The camming element(s) rotatably mounted on cylinder 210 continue to rotate during this portion of the engine cycle.

FIGS. 22-26 show cross-sectional views similar to those shown in FIGS. 12-17 and FIGS. 18-21, taken through the cylinder housing and cylinder during the power phase of the engine cycle. Combustion of the air-fuel mixture causes the pistons 120 and 130 to move away from the center of the cylinder, supplying power to the associated crankshafts in a known manner. The camming element(s) rotatably mounted on cylinder 210 continues to rotate during this portion of the engine cycle.

FIGS. 27-30 show cross-sectional views similar to those shown in FIGS. 12-17, FIGS. 18-21, and FIGS. 22-26, taken through the cylinder housing and cylinder during the exhaust phase of the engine cycle. As cylinder 210 and its associated camming elements continue to rotate, engagement between cam follower 704 on valve mechanism 34 and the cam surfaces forces associated valve portion 710 into an unseated (open) condition. Simultaneously, the pistons 120 and 130 move back toward the center of the cylinder, forcing the exhaust gases out through the exhaust port in valve mechanism 34 that was previously blocked by valve mechanism 34. The engine cycle is then repeated.

Referring to FIGS. 2-3 and 12-30, rotation of the crankshafts 140 and 142 responsive to motion of pistons 120 and 130 inside cylinder 210 produces rotation of associated gear train 112. This rotation of the gear train elements produces rotation of the bevel gears 250 and 252 and respective complementary bevel gears 220 and 220 attached to cylinder 210.

An opposed piston engine in accordance with an embodiment of the present invention may be incorporated in a known manner into a hybrid electric vehicle drive (not shown). For example, an embodiment of the opposed piston engine may be incorporated into a series hybrid drive train, a parallel hybrid drive train, or a series-parallel hybrid drive train.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments and such term is not intended to connote that such embodiments are necessarily extraordinary or superlative examples.

The terms "coupled," "connected," and the like as used herein means the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements, for example "top," "bottom," "above," "below," etc., are merely used to describe the orientation of various elements in the FIGURES. It should be noted that the orientation of various elements may differ according to other exemplary embodiments, and that such variations are intended to be encompassed by the present disclosure.

In general, it will be understood that the foregoing descriptions of the various embodiments are for illustrative purposes only. As such, the various structural and operational features herein disclosed are susceptible to a number of modifications, none of which departs from the scope of the appended claims.

What is claimed is:

1. An opposed piston engine comprising:

an engine housing;

at least one cylinder housing coupled to the engine housing; and a first cylinder supported by the at least one cylinder housing, the first cylinder having a first end and a second end opposite the first end, and a central portion located substantially in a center between the first and second cylinder ends, wherein each of the first and second cylinder ends is directly supported by and physically contacts the engine housing, wherein the engine housing has a first portion and a second portion extending from the first portion in a direction perpendicular to a longitudinal axis of the cylinder and the second portion directly supports and physically contacts the first end of the cylinder, and wherein said at least one cylinder housing is formed continuously about the complete circumference of the at least one cylinder and is formed to mount valve assemblies within said at least one cylinder housing.

2. The engine of claim 1, wherein the engine housing has a third portion extending from the first portion in a direction perpendicular to a longitudinal axis of the cylinder and the third portion directly supports and physically contacts the second end of the cylinder.

3. The engine of claim 1 further comprising a second cylinder having a third end and a fourth end, wherein the second portion extends from a first side of the first portion and further comprising a fourth portion extending from a second side of the first portion opposite the first side, wherein the second portion directly supports the first end of the first cylinder, and the fourth portion directly supports the third end of the second cylinder.

4. The engine of claim 1 wherein the housing second portion has a pair of opposed openings, each opening being structured to enable associated portions of a crankshaft to extend from the first portion and through the second portion.

5. The engine of claim 1 wherein the engine housing has a third portion extending from the first portion and spaced apart from the second portion, and wherein the cylinder first end is supported by the housing second portion and the cylinder second end is supported by the housing third portion.

6. The engine of claim 5 wherein the engine housing second portion is structured to provide a mounting structure for a portion of an associated first crankshaft operatively coupled to a first piston positioned in the cylinder, and wherein the engine housing third portion is structured to provide a mounting structure for a portion of an associated second crankshaft operatively coupled to a second piston positioned in the cylinder, wherein the third portion directly supports and physically contacts the second end of the first cylinder.

7. The engine of claim 5 wherein the cylinder is supported by the engine housing such that the cylinder is spaced apart from the housing first portion.

8. A cylinder structure for an opposed piston engine comprising a first end and a second end, the cylinder structure further comprising:

an inner cylinder portion having a length and a longitudinal central axis and a plurality of grooves formed along an exterior surface thereof; and an outer cylinder portion structured to receive the inner cylinder portion therein and to abut the exterior surface of the inner cylinder portion so as to form an associated plurality of coolant passages along the grooves, wherein said plurality of grooves extend from about the first end to about the second end, for substantially all of the length of the cylinder.

9. The cylinder structure of claim 8 wherein the grooves of the plurality of grooves extend along the inner cylinder portion parallel to a longitudinal central axis of the cylinder.

10. The cylinder structure of claim 8 wherein the grooves of the plurality of grooves are interconnected so as to permit a coolant to flow between adjacent grooves of the plurality of grooves.

* * * * *